US011661740B2

(12) United States Patent
Watkins

(10) Patent No.: US 11,661,740 B2
(45) Date of Patent: May 30, 2023

(54) SYSTEM, APPARATUS, AND METHOD FOR PROVIDING A PLANT-BASED STRUCTURAL ASSEMBLY

(71) Applicant: ORB Technologies, LLC, Lexington, KY (US)

(72) Inventor: Virginia Watkins, Lexington, KY (US)

(73) Assignee: ORB TECHNOLOGIES, LLC, Lexington, KY (US)

( * ) Notice: Subject to any disclaimer, the term of this patent is extended or adjusted under 35 U.S.C. 154(b) by 0 days.

(21) Appl. No.: 17/496,371

(22) Filed: Oct. 7, 2021

(65) Prior Publication Data

US 2023/0116147 A1 Apr. 13, 2023

(51) Int. Cl.
*E04C 2/16* (2006.01)
*E04C 2/40* (2006.01)

(52) U.S. Cl.
CPC . *E04C 2/16* (2013.01); *E04C 2/40* (2013.01)

(58) Field of Classification Search
CPC ..... E04C 2/16
See application file for complete search history.

(56) References Cited

U.S. PATENT DOCUMENTS

| | | | |
|---|---|---|---|
| 1,604,097 | A | 10/1926 | Hewlett |
| 2,369,006 | A | 2/1945 | Banks |
| 3,440,130 | A | 4/1969 | Telkes |
| 4,021,983 | A | 5/1977 | Kirk |
| 5,749,199 | A | 5/1998 | Allen |
| 6,951,080 | B2 | 10/2005 | Korman |
| 7,481,960 | B2 | 1/2009 | Ward |
| 7,707,784 | B2 | 5/2010 | Korman |
| 8,161,697 | B1 | 4/2012 | McDonald |
| 8,173,236 | B1 | 5/2012 | McDonald |
| 8,414,816 | B2 | 4/2013 | Korman |
| 8,448,410 | B2 | 5/2013 | Korman |
| 8,561,373 | B1 | 10/2013 | McDonald |
| 8,733,061 | B1 | 5/2014 | McDonald |
| 9,447,557 | B2 | 9/2016 | Schiffmann |
| 9,850,660 | B2 | 12/2017 | Li |

(Continued)

FOREIGN PATENT DOCUMENTS

| | | | |
|---|---|---|---|
| CA | 2229589 | A1 | 4/1998 |
| CN | 1037859 | A | 5/1988 |

(Continued)

OTHER PUBLICATIONS

Bertin & Cie [FR], Dec. 1975, Machine_Translate_FR2271044 (Year: 1975).*

(Continued)

*Primary Examiner* — Babajide A Demuren
(74) *Attorney, Agent, or Firm* — Keefe IP Law, PLLC

(57) ABSTRACT

An apparatus for resisting a gravity load is disclosed. The apparatus has a first end member, a second end member, and a plurality of elongated structural members, each of the plurality of elongated structural members including a first end portion attached to the first end member and a second end portion attached to the second end member. The plurality of elongated structural members is oriented to resist compressive stresses or tensile stresses induced by the gravity load. The plurality of elongated structural members is formed from plants with a harvest cycle of four years or fewer.

29 Claims, 17 Drawing Sheets

(56) References Cited

U.S. PATENT DOCUMENTS

| | | | | |
|---|---|---|---|---|
| 9,962,894 | B1 | 5/2018 | McDonald | |
| 10,125,491 | B1 | 11/2018 | McDonald | |
| 10,195,821 | B1 | 2/2019 | McDonald | |
| 10,240,285 | B2 | 3/2019 | Wilson | |
| 10,414,120 | B2 | 9/2019 | Theuerkorn | |
| 10,442,111 | B1 | 10/2019 | McDonald | |
| 2003/0157301 | A1 | 8/2003 | Murcia | |
| 2005/0223671 | A1* | 10/2005 | Korman | E04B 2/02 52/607 |
| 2006/0062959 | A1 | 3/2006 | Gerardo Elpidio | |
| 2009/0038249 | A1* | 2/2009 | Coulton | E04B 1/66 52/409 |
| 2009/0077920 | A1 | 3/2009 | Korman | |
| 2011/0036042 | A1 | 2/2011 | Slaven, Jr. | |
| 2011/0135887 | A1 | 6/2011 | Saff | |
| 2018/0258633 | A1 | 9/2018 | Power | |

FOREIGN PATENT DOCUMENTS

| | | | | |
|---|---|---|---|---|
| CN | 2179816 | Y | 12/1993 | |
| CN | 2770965 | Y | 12/2004 | |
| CN | 103144181 | A | 4/2013 | |
| CN | 203171763 | U | 4/2013 | |
| CN | 110978158 | A | 12/2019 | |
| DE | 880931 | C | 12/1951 | |
| DE | 2836418 | A1 | 8/1978 | |
| DE | 4238562 | A1 | 11/1992 | |
| DE | 4230990 | A1 * | 5/1993 | E04C 2/16 |
| DE | 42385621 | A1 | 5/1993 | |
| DE | 10217815 | A1 | 4/2002 | |
| DE | 202017000543 | U1 | 2/2017 | |
| EP | 3332072 | B1 | 7/2016 | |
| FR | 2271044 | A1 | 11/1973 | |
| FR | 2914582 | A1 | 4/2007 | |
| KR | 20190004614 | A | 7/2017 | |
| SE | 303025 | B | 11/1964 | |
| WO | WO-9302259 | A1 * | 2/1993 | B32B 5/26 |
| WO | WO-9303235 | A2 * | 2/1993 | B29C 70/24 |

OTHER PUBLICATIONS

Written Opinion and International Search Report dated Dec. 8, 2022, in counterpart international patent application PCT/US2022/077570.

"Young Inventors Program (YIP)", Ashland School of Environmental Technology, Home of the Strawjet Project, http://www.greeninventor.org/yip.shtml, accessed Sep. 22, 2021.

Broadbent, G. (2008) "The Ecology of the Mudhif", WIT Transactions on Ecology and the Environment, vol. 113, www.witpress.com, ISSN 1743-3541 (on-line), https://www.witpress.com/Secure/elibrary/papers/ARC08/ARC08002FU1.pdf.

Camann, K.R., (2009) Design and Performance of Load Bearing Shear Walls Made from Composite Rice Straw Blocks [Master's thesis, California Polytechnic State University, San Luis Obispo] https://digitalcommons.calpoly.edu/theses/218/.

Selcuk, Seda, Anthony J. Lamanna, Feasibility Investigation of Oriented Straw Cable Cement Composites Composites: Part A 38 (2007) 1965-1974, Elsevier publisher.

Krus M., Th. Großkinsky, H.M. Künzel, (2016) A New Load-Bearing Insulation Material Made of Cattail, Powerpoint Presentation given at Oak Ridge National Laboratory, 2016 https://web.ornl.gov/sci/buildings/2016/docs/presentations/workshops/workshop-4/Workshop4_Kuenzel.pdf, accessed Sep. 22, 2021.

* cited by examiner

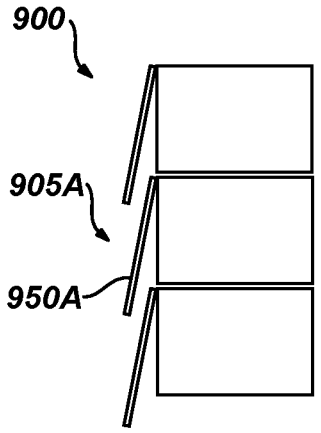
Fig. 9A
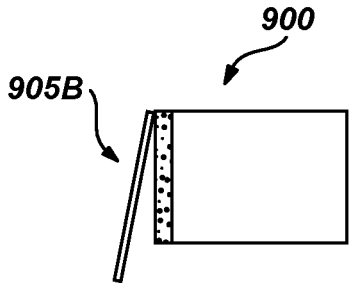
Fig. 9B
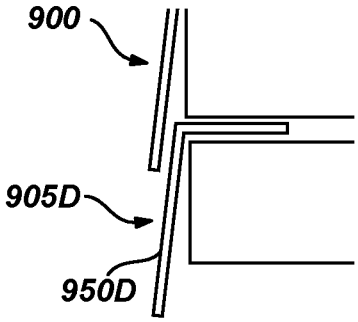
Fig. 9D
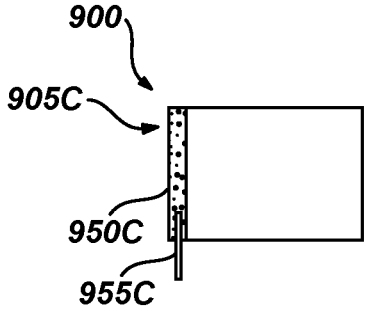
Fig. 9C
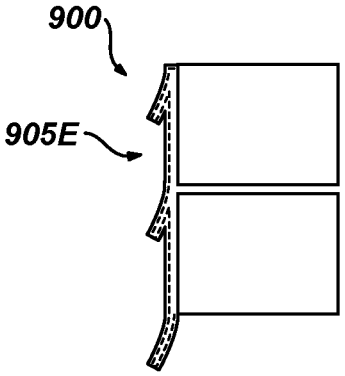
Fig. 9E1
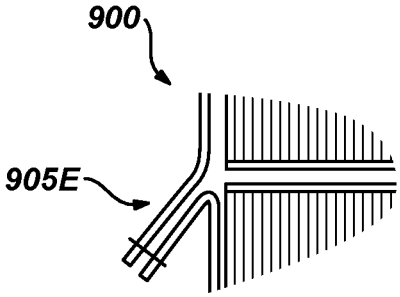
Fig. 9E2

SYSTEM, APPARATUS, AND METHOD FOR PROVIDING A PLANT-BASED STRUCTURAL ASSEMBLY

STATEMENT OF GOVERNMENT INTEREST

This material is based upon work that is supported by the National Institute of Food and Agriculture, U.S. Department of Agriculture Small Business Innovation Research (SBIR) Program, under award number 2017-33610-27014. The U.S. Government may have certain rights in this invention.

TECHNICAL FIELD

The present disclosure generally relates to a system, apparatus, and method for providing an assembly, and more particularly to a system, apparatus, and method for providing a plant-based structural assembly.

BACKGROUND

Although concrete and steel materials are energy-intensive and carbon-intensive to produce, they are currently the predominant materials used for construction and urban development. Together they account for an estimated 14.7 percent of climate emissions according to some sources. Biobased materials are seen as a potential way to transition the building industry from constituting a major climate polluter to being part of the solution to climate-related challenges. Many biobased materials and construction systems have been developed by researchers and practitioners with the aim of reducing carbon and other environmental impacts, but the solutions developed thus far have deficiencies in the face of the scale of catastrophic climate effects projected by the International Panel on Climate Change.

Mass timber construction recently has seen a dramatic rise in interest as a low environmental impact alternative to steel and concrete that is usable in multi-story buildings including high rises and in urban and commercial environments subject to fire risk. At the same time, due to this increased demand, there is also growing concern about its impact. Namely, there are questions about the ability of supply to keep up with demand without putting undue pressure on forest ecosystems. There are also concerns about the slow cycle time of carbon sequestration in structural timber being too long to function as a practical method to store carbon within the 30-year timeframe remaining in which carbon emissions are to be brought down to zero. Most importantly, there are uncertainties about the potential risk of releasing more carbon from forest soils than is stored in the wood itself.

Other development has utilized plants with short growth cycles or agricultural residues as construction materials with greater potential to serve as low risk, low-cost carbon storage. However, adoption of these natural building techniques, such as strawbale construction, light straw clay, hemperete, modern thatching, and others has been hampered by various disadvantages. Significant skill is involved to adjust and fit variously-sized strawbales into a straight wall or to test and develop plaster mixes using local soils. Many of these building methods involve protection from rain during construction. Many use wet processes (such as hemperete, light straw clay and strawbale with earth plaster skins), which introduce large volumes of moisture into a building at the outset that introduces the risk of mold if a structure is not dried out quickly. These building methods also tend to be labor-intensive, which in practice, has meant that the fledgling industry either primarily uses volunteer labor to build projects or involves high-cost custom projects, both of which have hampered adoption of these methods on a broad scale. Lastly, these methods are typically limited to low rise construction.

U.S. Pat. No. 8,448,410 issued to Korman in 2013 (the '410 patent) attempts to address some of the above shortcomings in the prior art by providing a load-bearing and insulating culm block made of vertically aligned straw stalks having a binder disposed on or integrated into the stalks. The blocks of the '410 patent can be dry stacked without mortar to build a wall. However, at the maximum compressive strength of 45 pounds per square inch (psi) disclosed by the '410 patent, buildings made using 12 inch wide blocks, if a common safety factor of three is assumed, would apparently be limited to relatively low heights such as two stories The exemplary disclosed system, apparatus, and method of the present disclosure are directed to overcoming one or more of the shortcomings set forth above and/or other deficiencies in existing technology.

SUMMARY OF THE DISCLOSURE

In one exemplary aspect, the present disclosure is directed to an apparatus for resisting a gravity load. The apparatus includes a first end member, a second end member, and a plurality of elongated structural members, each of the plurality of elongated structural members including a first end portion attached to the first end member and a second end portion attached to the second end member. The plurality of elongated structural members is oriented to resist compressive stresses or tensile stresses induced by the gravity load. The plurality of elongated structural members is formed from plants with a harvest cycle of four years or fewer.

In another aspect, the present disclosure is directed to a method for resisting a gravity load. The method includes providing a first end member, providing a second end member, attaching a first end portion of each of a plurality of elongated structural members to the first end member, attaching a second end portion of each of the plurality of elongated structural members to the second end member, and resisting the gravity load by resisting at least one of tensile or compressive stresses induced by the gravity load in the plurality of elongated structural members. The plurality of elongated structural members is formed from plants with a harvest cycle of four years or fewer.

BRIEF DESCRIPTION OF THE DRAWINGS

FIGS. 4J through 4S are perspective views of exemplary embodiments of multiple systems of structural assemblies including various configurations of a cavity wall, a curved wall, fence-like walls, pre-fabricated wall panels, insulated concrete forms, and other exemplary embodiments of the present invention;

FIGS. 6A1 and 6A2 through 6D are side and perspective views of various exemplary configurations for connecting structural members to end members without adhesive in accordance with embodiments of the present invention;

FIGS. 8A through 8G are side, perspective and plan views of a system of structural assemblies including a variety of techniques of joining dry stacked blocks or other methods in accordance with additional exemplary embodiments;

FIGS. 9A through 9H are side views of a system of structural assemblies including various configurations of a water resistive barrier in accordance with exemplary embodiments;

DETAILED DESCRIPTION AND INDUSTRIAL APPLICABILITY

Figure 1:
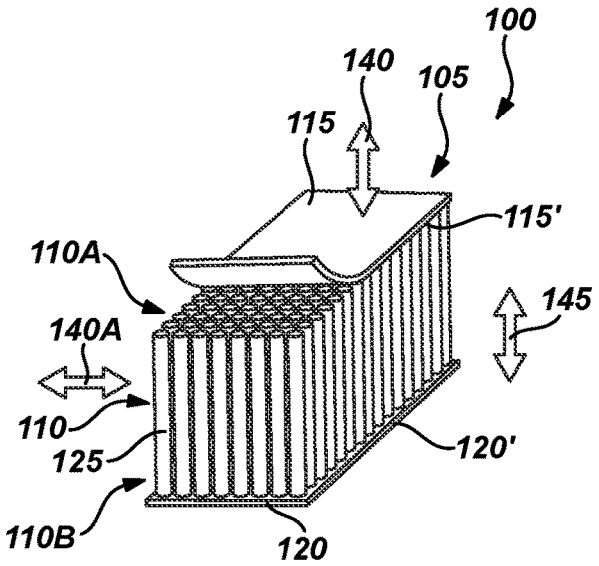
FIG. 1 is a perspective view of a structural assembly in accordance with an exemplary embodiment of the present invention.
Figure 2:
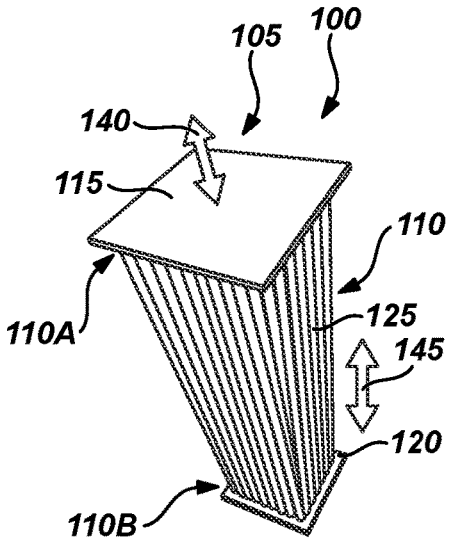
FIG. 2 is a perspective view of a structural assembly in accordance with an exemplary embodiment of the present invention.

FIGS. 1 and 2 illustrate an exemplary embodiment of the exemplary disclosed system, apparatus, and method. System 100 may include a structural assembly 105. Structural assembly 105 may include a core assembly 110 and a plurality of end members such as a first face layer or first end member 115 and a second face layer or second end member 120. First end member 115 may be attached to a first end portion 110A of core assembly 110 and second end member 120 may be attached to a second end portion 110B of core assembly 110.

Core assembly 110 may include a plurality of structural members 125. Structural member 125 may be a load-resisting element. Structural member 125 may be an elongated structural member (e.g., an elongated segment).

In at least some exemplary embodiments, structural member 125 may be a member formed from plant material. Structural member 125 may be a plant-based member. Structural member 125 may be formed from any suitable biocomposite material. Structural member 125 may be formed from grass. Structural member 125 may be formed from a structural grass, a load-resisting grass, a stiff grass, a rigid grass, a semi-rigid grass, and/or a minimally rigid grass such as, for example, bamboo, switchgrass, maize, straw, and other suitable structural plant material for example as described herein. Structural members 125 may be formed from plants of the Poales order. Structural members 125 may include Poales (e.g., plants of the Poales order) such as Poaceae (e.g., Gramineae), Typhaceae, Cyperaceae, Juncaceae, and/or other plant families that may exclude trees (e.g., non-tree or non-wood families of plants such as Poales plants). For example, structural member 125 may be a Poales grass (e.g., a plant such as grass and other suitable plants of the Poales order). Structural member 125 may be formed from stems of rapidly renewable, biomass trees. Structural member 125 may be formed from living plant material. Structural member 125 may be an elongated plant segment. Structural member 125 may be a plant stalk. For example, the plurality of structural members 125 may be substantially aligned, elongated plant segments or stalks. Structural member 125 may be a switchgrass stalk. Structural member 125 may be a miscanthus stalk. Structural member 125 may be corn stalk material, sorghum material, cattail material, *miscanthus giganteus* material, kenaf material, and/or any other suitable plant material. Structural members 125 may include rice straw and/or bamboo. For example, structural member 125 may be miscanthus, switchgrass, hemp, kenaf, willow, giant cane, or bamboo. Structural members 125 may include combinations of any suitable plant type or species such as, for example, miscanthus, switchgrass, corn, rice, wheat, rye, oats, sorghum, reed, willow, hemp, kenaf, giant cane, river cane, bamboo, corn cobs, cattail leaves, and/or palm fronds. Structural members 125 may be formed from non-wood material (e.g., from non-wood or non-tree plants). The plurality of structural members 125 of core assembly 110 may include one or more (e.g., a combination) of the exemplary disclosed materials described herein.

In at least some exemplary embodiments, structural member 125 may be a tube, a rod, a cylinder, a pipe, a shaft, a hollow member, a cylindrical member, a tubular member, rod-like, and/or tube-like. Structural members 125 may be juxtaposed side-by-side. Structural member 125 may be a vegetable straw, a vegetable stalk, an osier, a switch, a bar of vegetable origin, a vegetable stem, a stem, an internode, a shoot, a frond, a core, a furled leaf, a fast-growing plant trunk (e.g., not a tree or wood), an elongated plant particle, an oblong plant member, and/or a natural fiber material. Structural member 125 may be a reed, and/or a strand.

Structural member 125 may be a lignocellulosic member, cane, and/or a graminaceous plant In at least some exemplary embodiments, structural member 125 may be formed from plant or organic material such as lignocellulosic material, straw, hay, grass, perennials, silage, bagasse, agrifiber plants, agricultural residue, agricultural waste, agricultural biomass, agricultural byproducts, corn stover, forage, forage crop, fiber crop, rapeseed stalk, jute, bagasse, cereal grain straw, wheat, rye, barley, oat, rice, corn, sorghum, hemp, kenaf, flax, linen, cattail, switchgrass, prairie grass, native grasses, sudangrass, bamboo, giant cane, river cane, reed, rattan, tobacco, Jerusalem artichoke, sunflower, palm, pampas grass, willow, black locust, poplar, coppice tree stems, pollard tree stems, balsa, Poaceae, *Cortaderia, Arundinaria, Miscanthus, Typha, Panicum, Arundo, Phragmites, Ailanthus, Salix*, and/or *Robinia*. Structural member 125 may be bio-based, biomass, vegetal, natural, fast-growing, rapidly renewable material and/or have a harvest cycle of 4 years or fewer. Structural member 125 may be natural, organic material of plant origin.

In at least some exemplary embodiments, structural member 125 may retain characteristics of a living plant. For example, living plant stalks may cantilever (e.g., from the ground) and resist loading (e.g., resist wind loading such as from breezes) without collapse based on structural material being efficiently disposed in a circumferential ring or other perimeter or annular form (e.g., or polygonal cross-section such as a C-shaped or triangular cross-section), thus providing stiffness to the stalk with a minimal amount of material. Structural member 125 may retain these natural properties, taking advantage of strength, stiffness, and/or low weight, as well as water shedding and other properties imparted by the natural arrangement of materials within a substantially preserved plant stalk. Structural member 125 may be a whole plant segment resembling its natural form. Structural member 125 may be an intact plant stalk that has few (e.g., relatively few) splits, bends, or crushed portions. Structural member 125 may be an elongated plant segment with substantially preserved circumference or natural cross section or be a plant stalk with substantially intact surface or epidermis. Structural member 125 may be a stalk with a hydrophobic surface having an initial water contact angle of 85 or more, being water-resistant and having improved (e.g. reduced) moisture absorption properties including water absorption rate and amount relative to comminuted biomass particles. The higher the contact angle of the material, the more hydrophobic the surface and the less wettable it may be. In some exemplary embodiments having plugged stalk ends and being submerged in water for 24 hours, the amount of moisture absorbed may be reduced to a level that may be comparable to that of some densities of expanded polystyrene foam insulation. Structural member 125 may be a substantially unpunctured, unsplit, unbent, or uncrushed portion of a plant stalk. When structural member 125 may be formed from plant material such as corn, sorghum, cattail, *Miscanthus giganteus*, and kenaf, a perimetral cross-section of structural member 125 may be braced by a pithy or solid core. When structural member 125 may be formed from plant material such as switchgrass or rice straw, a stem of structural member 125 may be hollow.

In at least some exemplary embodiments, the exemplary disclosed composite of structural member 125 may also serve as thermal insulation, and may have relatively increased (e.g., improved) insulative properties in directions perpendicular to a length direction (e.g., a stalk length direction). An insulating effect of structural member 125 may be supported by an arrangement of multiple cells of hollow or pithy stem cores of structural member 125 as well as a discontinuous (e.g., circuitous) conduction path between structural members 125 perpendicular to their length. In at least some exemplary embodiments, a lack or avoidance of binding agent along a stalk length (e.g., an intermediate portion) of structural member 125 may enhance insulative properties. Structural members 125 may have improved noise attenuation properties.

Figure 2A:
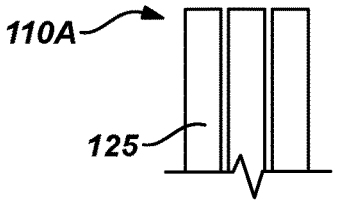
FIGS. 2A through 2D are close-up side views of structural members in accordance with exemplary embodiments of the present invention.
Figure 2B:
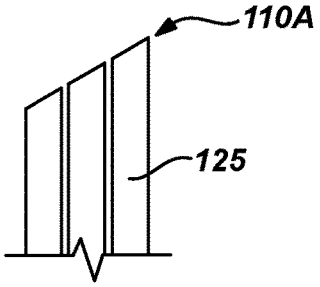
Figure 2C:
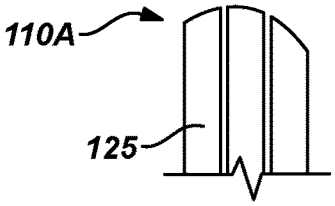
Figure 2D:
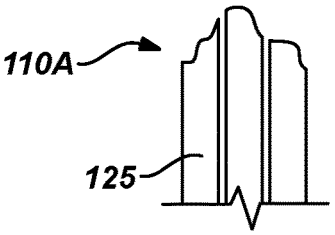

In at least some exemplary embodiments, structural members 125 may be cut (e.g., to have cut end faces) at first end portion 110A and second end portion 110B. For example, structural members 125 may be cut (e.g., trimmed, sliced), faceted, fashioned, shaped, or flattened at an end portion. FIGS. 2A through 2D illustrate exemplary embodiments of cut end faces of structural members 125 at first end portion 110A (e.g., a close-up side view). For example, structural members 125 may be cut flat (e.g., FIG. 2A), on a diagonal (e.g., FIG. 2B), forming a curved surface (e.g., FIG. 2C), or forming any desired contour (e.g., FIG. 2D). For example, structural members 125 may have straight cut ends (e.g., as illustrated in FIGS. 2A and 2B), single curvature cut ends (e.g., as illustrated in FIG. 2C), and/or multi-curvature cut ends (e.g., as illustrated in FIG. 2D). For example, structural members 125 may be cut to be flat and perpendicular to a stalk length such that edge portions of adjacent structural members 125 are at substantially the same elevation or may be cut to form any desired contour (e.g., shown in FIGS. 2A through 2D with for example exaggerated gaps). The exemplary disclosed cut ends of structural members 125 and/or end members 115 and/or 120 may serve as interconnections between elements, provide for shedding of rainwater, provide blocking of wind-blown rain, create channels for electrical runs, and/or serve any other suitable purpose.

First end member 115 and second end member 120 may be any suitable members for attaching to end portions (e.g., respective first end portion 110A and second end portion 110B) of core assembly 110. For example, first end member 115 and second end member 120 may be formed from any suitable material for attaching to end portions (e.g., respective first end portion 110A and second end portion 110B) of core assembly 110. End members 115 and 120 may be any suitable members for joining end portions of structural members 125 at respective end portions 110A and 110B of core assembly 110. For example, first end member 115 may join end portions of structural members 125 at first end portion 110A of core assembly 110. Also for example, second end member 120 may join end portions of structural members 125 at second end portion 110B of core assembly 110. First end member 115 and second end member 120 may be joining members that join or attach (e.g., structurally join or attach) end portions (e.g., end portions 110A and 110B) of core assembly 110.

Figure 3A:
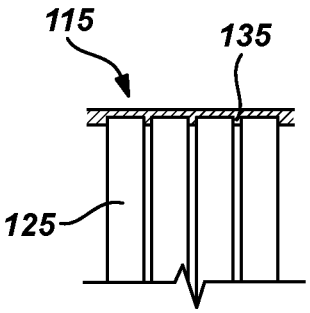
FIGS. 3A through 3E are close-up side views of various exemplary configurations for attachment of structural members in accordance with exemplary embodiments of the present invention.
Figure 3B:
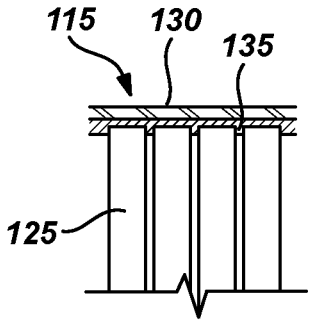
Figure 3C:
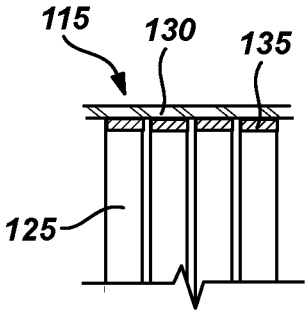
Figure 3D:
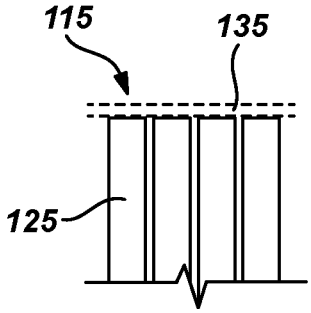
Figure 3E:
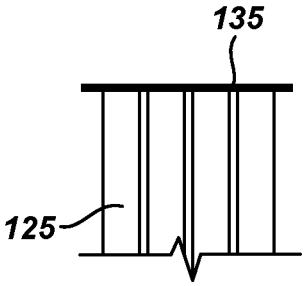

In at least some exemplary embodiments and for example as illustrated in FIGS. 3A through 3J, first end member 115 and second end member 120 may each include a substrate layer 130 and/or an attachment layer 135. In at least some embodiments, substrate layer 130 may be integrally formed with attachment layer 135 (e.g., or attachment layer 135 may also serve as a substrate layer) as shown in FIGS. 3A, 3D and 3E. In at least some exemplary embodiments, first end member 115 and/or second end member 120 may include an attachment layer 135 and may not include a substrate layer 130. In at least some exemplary embodiments, attachment layer 135 may attach structural members 125 to substrate layer 130 as illustrated in FIGS. 3B and 3C. In at least some exemplary embodiments, attachment layer 135 may attach end portions of structural members 125 directly to each other (e.g., at end portions 110A and/or 110B). In at least some exemplary embodiments, attachment layer 135 may attach end portions of stacked structural members 125 directly to each other (e.g., at end portions 110A and/or 110B). In at least some exemplary embodiments, attachment layer 135 may attach end portions of stacked structural members 125 to opposite sides of a single substrate layer 130 (e.g., at end portions 110A and/or 110B). FIGS. 3A through 3J illustrate various exemplary embodiments for attachment of structural members 125 via substrate layer 130 and/or attachment layer 135. For example, FIGS. 3A to 3J illustrate a variety of techniques for joining cut ends (e.g., stalk cut ends) of structural members 125. Structural members 125 may also be attached to each other and/or substrate layer 130 and/or attachment layer 135 via any other suitable technique such as via mechanical fasteners, taught fabric wrap, both of which will be discussed further below, and/or any other suitable attachment technique.

Substrate layer 130 may be any suitable material for being attached via attachment layer 135 to structural members 125 (e.g., at end portions 110A and/or 110B of core assembly 110). In at least some exemplary embodiments, substrate layer 130 may be formed from sheet material. For example, substrate layer 130 may be formed from paper, paper cardstock, sheet metal, plywood, oriented strand board (OSB), wood veneer, laminated wood veneer, fiber cement board, magnesium board, fiber reinforced polymer sheet, fiber cement board, compressed earth block and/or fiberboard. Substrate layer 130 may be treated with adhesion-enhancing material. For example, substrate layer 130 may be pre-impregnated with mycelium, resin, or lignin (e.g. such as wood veneer with natural lignin content bound by friction bonding).

In at least some exemplary embodiments, substrate layer 130 may be formed from flexible or semiflexible reinforcing material. For example, substrate layer 130 may be formed from fabric, gauze, burlap mesh, fiberglass mesh, metal screen, and/or plastic grid. Substrate layer 130 may be formed from thermoplastic film. Substrate layer 130 may have spanning capability for adhesion to end portions of structural members 125, for example by melting biodegradable plastic films such as polylacticacid (PLA), polyhydroxybutyrate (PHB), and polyhydroxyalkanoate (PHA) or nonbiodegradable plastic films such as high density polyethylene (HDPE) with or without reinforcing fibers.

Attachment layer 135 may be formed from any suitable material for attaching structural members 125 to substrate layer 130 and/or for attaching end portions of structural members 125 directly to each other (e.g., at end portions 110A and/or 110B). In at least some exemplary embodiments, attachment layer 135 may be formed from a gap filling material. For example, attachment layer 135 may be formed from a thermoplastic adhesive mixture of lignin, lac, and/or plant oil with embedded wood fiber reinforcing (e.g. Arboform™ sourced from Tecnaro in Ilsfeld, Germany). Material of attachment layer 135 may be heat-extruded as a semi-liquid onto end portions of structural members 125 or thermoformed from a solid sheet or pellets directly onto end portions of structural members 125 using a hot press. In at least some exemplary embodiments, end member 115 and/or end member 120 may be comprised of attachment layer 135 that may be formed from dried or cured material such as the exemplary disclosed material or attachment layer 135 described herein.

In at least some exemplary embodiments, attachment layer 135 may be formed from any suitable material that may adhere to structural members 125 (e.g., stalk cut ends), span small gaps between end portions of structural members 125, and/or may be resistant to brittle fracture (e.g., may effectively hold structural members 125 together or to substrate layer 130). Attachment layer 135 may be formed from adhesive material such as, for example, fiber reinforced mortars including thin set cement mortar, earth plaster, lime plaster, gypsum plaster, magnesium phosphate cement mortar, geopolymers, aerated concrete and/or similar materials. Attachment layer 135 may be formed from wet laid paper pulp. Material of attachment layer 135 may be cast, foamed, air laid, sprayed or dispersed on cut end surfaces of structural members 125. Also for example, end portions of structural members 125 may be dipped into material of attachment layer 135 (e.g., a bed of material such as mortar), and allowed to cure by air, water, and/or carbon dioxide exposure (e.g., with or without added gas pressure). Also for example, attachment layer 135 may be formed from gap-filling adhesive material such as fiber reinforced plastic (FRP) with epoxy, polyester or other thermoset resins, poly vinyl acetate (PVA) glue, starch based adhesives, lignin, natural protein glues (e.g., made from hides, gelatin, casein, soy protein and/or blood), oxidized drying oils such as linseed (rapeseed), hempseed, and/or soybean oil.

In at least some exemplary embodiments, attachment layer 135 may be formed from material such as polyurethane adhesives with fibers, hot melt adhesives or thermoplastics that may be melted and applied in a molten state, phenol-formaldehyde, MDI, resin material, and/or rubber-system adhesives (e.g., such as those derived from dandelion roots). Attachment layer 135 may be formed from straw or cork material bonded through excitation of internal natural binders such as lignin bonds using heat and moisture, from a biocement that is nourished and permitted to grow around the cut ends of structural members 125, and/or any other suitable biobased adhesive material. Attachment layer 135 may be formed from mycocomposite adhesive material (e.g., composed of biofibers and fungal mycelia that may be pre-grown as a loose particle matrix and then pressed into the stalk surface with or without added heat) or mycelia grown directly on end portions of structural members 125 (e.g., frayed stalk ends) with or without added nutrients.

In at least some exemplary embodiments, attachment layer 135 may include any suitable reinforcing fiber. For example, attachment layer 135 may include reinforcing fiber material such as carbon fiber, fiberglass, metal reinforcing, and/or biofibers such as plant bast fibers, wool, biopolymers, synthetic polymers, cotton, hemp, kenaf, sisal, flax, wood, waste paper pulp, and/or miscanthus.

Figure 3F:
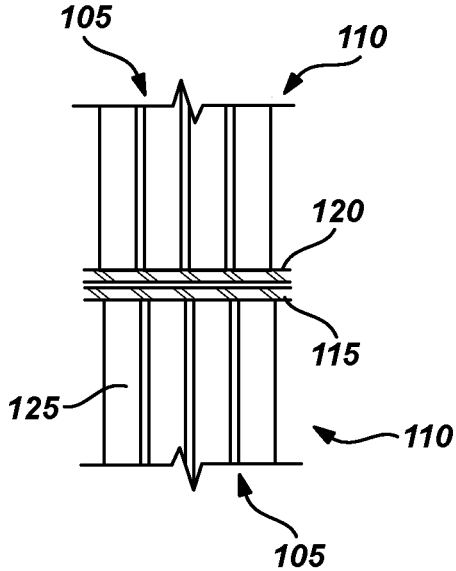
FIGS. 3F through 3J are close-up side views of various exemplary configurations for joining two adjacent structural assemblies in accordance with exemplary embodiments.
Figure 3G:
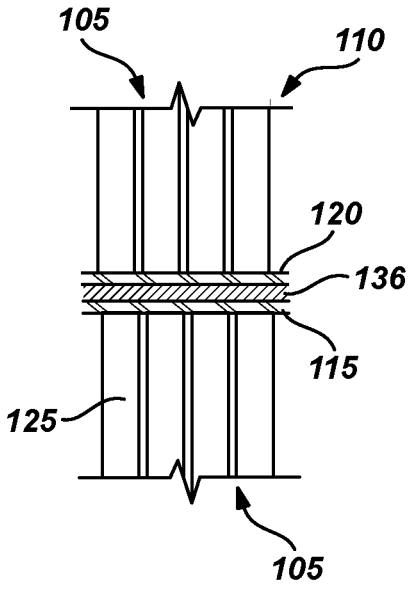
Figure 3H:
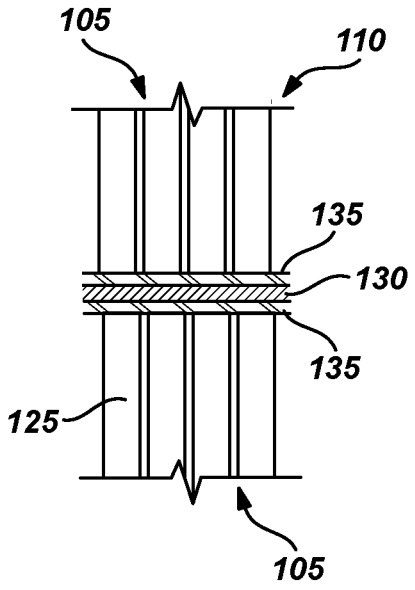
Figure 3I:
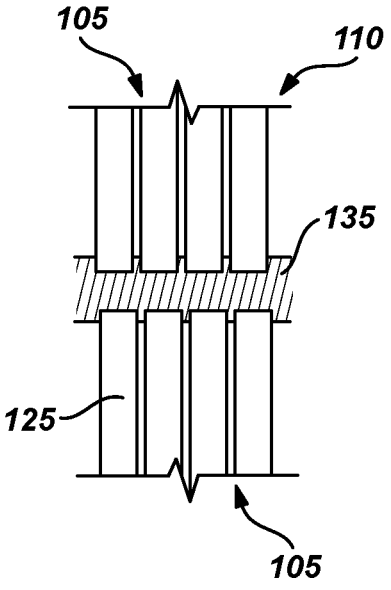
Figure 3J:
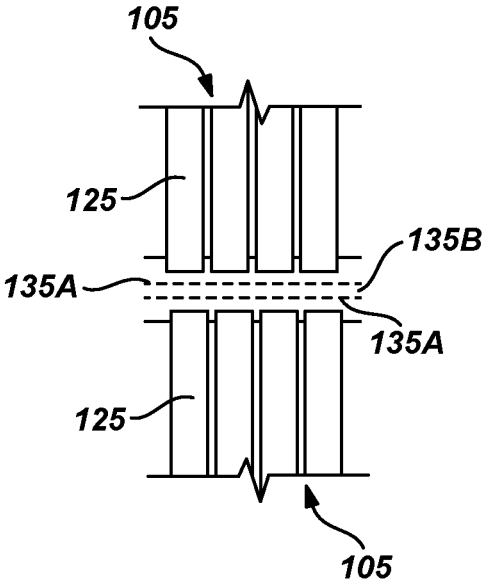

For example as illustrated in FIGS. 3F through 3J, various exemplary methods and configurations for joining two adjacent structural assemblies 105 may be utilized. For example as illustrated in FIG. 3F, structural assemblies 105 may be joined by being dry-stacked on one another without intervening adhesive, in which case structural assemblies 105 of system 100 may be held together via applied force to induce friction between said structural assemblies 105. For example as illustrated in FIG. 3G, adjacent structural assemblies 105 may each have their own separate end members 115 and 120 (e.g. face layers may be attached to their own respective structural members 125 via any suitable method disclosed herein) and may be joined together via an intervening adhesive 136. For example as illustrated in FIG. 3H, system 100 may include a single layer of sheet material (e.g., substrate layer 130 and/or attachment layer 135) to which two groups of structural assemblies 105 may be adhered (e.g., end portions of respective structural members 125 may be adhered). For example as illustrated in FIG. 3I, adjacent structural assemblies 105 (e.g., two groups of stalk ends of structural members 125) may be held together via a gap-filling adhesive (e.g., attachment layer 135) that may be shared between them. Further for example and as illustrated in FIG. 3J, multiple separate structural assemblies 105 (e.g., blocks) may be formed with adhered adhesive-infused flexible sheets (e.g., attachment layer 135) such the structural assemblies may be joined together (e.g., later joined together) via a gap-filling adhesive or mortar (e.g., a first attachment layer 135A and/or a second attachment layer 135B). The exemplary disclosed techniques may provide a simple manufacturing process utilizing a low-cost, biodegradable, non-structural binder (e.g., a starch) for the intermediate form with a cost-effective mortar utilized on-site (e.g., a thin set mineral binder) while creating a structural composite that may be compostable at an end of a service life of system 100.

In at least some exemplary embodiments, structural assembly 105 may serve as a building component such as a panel, a block, a plank, and/or a wall member. A plurality of structural assemblies 105 of system 100 may form a portion of or a substantially entire wall, floor, roof, column, beam, ceiling, partition, moveable partition, and/or any other suitable structure.

Returning to FIGS. 1 and 2, load or force may be applied to structural assembly 105 in a direction 140 that may be parallel to (e.g. to within 10 degrees of) a length of structural members 125. For example, load or loading force (e.g., a primary loading force such as a gravity force) may be applied in a direction that may axially load structural members 125. Loading in direction 140 may load structural members 125 in compression and/or tension. Loading direction 140 may result in internal stresses within structural members 125, including compressive stresses and/or tensile stresses. Internal stresses in direction 145 may be parallel to the length of structural members 125. For example, an axial load may be applied vertically from top to bottom of structural assembly 105 in direction 140 between end portions 110A and 110B with end member 120 supported flat on a support. End members 115 and 120 may restrain end portions of structural members 125 (e.g., at end portions 110A and 110B of core assembly 110) from moving when structural assembly 105 is loaded in direction 140. Structural members 125 may thereby structurally function as a group of columns (e.g., a group of small columns) such as with pinned and/or fixed ends. Such exemplary disclosed loading in direction 140 may be used in loadbearing walls and/or columns, in which case, structural members 125 are vertically aligned relative to the ground.

Structural assembly 105 may also be used to resist compression and/or tension stresses due to bending loads in members such as beams, floors, roofs, and other spanning members. In this orientation, spanning members with end supports (e.g. supported on the edge of the first end member 115' and the edge of second end member 120') experiencing gravity loads such as in direction 140A (e.g. from side to side of structural assembly 105) may result in compression and tension in direction 145 such that the internal stresses are parallel to the length of structural members 125. For example, in both cases including axially loaded members and spanning members, internal stresses within structural members 125 may be predominantly compressive and/or tensile stresses that may be parallel to the length of structural members 125.

Also for example, shear stresses may be resisted in structural assembly 105 primarily by the cross section of attachment layer 135, with some assistance from friction between structural members 125. The orientation of structural members 125 (e.g. plant stalks) is counter to that used in known sandwich panels with stalk cores. Sandwich panel cores have the stalks oriented 90 degrees from those of the disclosed assembly. In sandwich panel constructions, the plant stalks are parallel to the ground in wall applications and perpendicular to the ground in floor applications, and in both instances, resist shear stresses when loaded with a gravity load. The plant stalks in sandwich panels serve to brace the structural panel faces or skins.

Figure 4A:
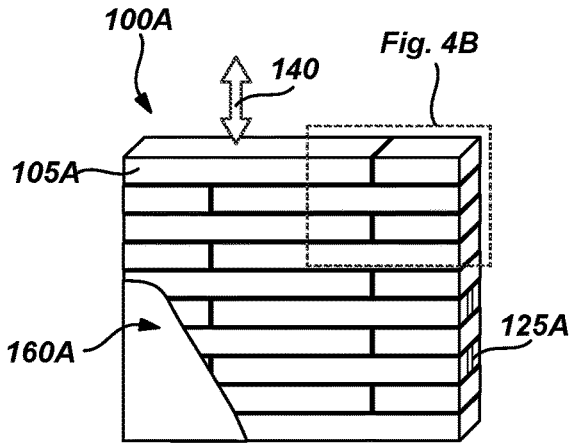
FIGS. 4A through 4D are perspective views of various configurations of a system of structural assemblies including a load bearing, insulating wall in accordance with exemplary embodiments.
Figure 4B:
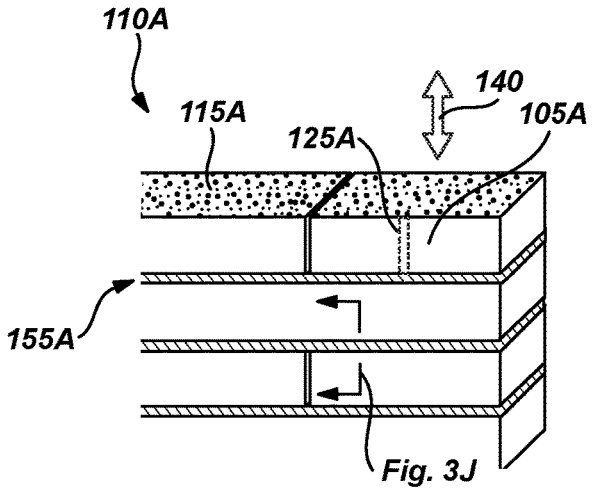

FIGS. 4A and 4B illustrate another exemplary embodiment of the exemplary disclosed system, apparatus, and method. System 100A may include a plurality of structural assemblies 105A that may be similar to structural assembly 105. Structural assembly 105A may be for example a block (e.g., a biocomposite block). Structural assembly 105A may include a plurality of structural members 125A that may be similar to structural member 125 and that may be oriented similarly as structural members 125 relative to direction 140. Structural members 125A may be attached or joined via any suitable technique such as, for example, as described above (e.g., regarding FIGS. 3A through 3E or as disclosed herein).

FIG. 4A illustrates a perspective view showing a loadbearing (e.g., bearing load in direction 140), insulating wall made up of structural assemblies 105A. In the loadbearing wall, structural members 125A are parallel to the height of the wall (e.g. vertically aligned) and oriented perpendicular to the thickness of the wall. In at least some exemplary embodiments, structural assemblies 105A may be assembled into a wall by mortaring joints and stacking structural assemblies 105A with staggered joint ends. Any suitable shapes, dimensions, weights, and densities may be used for structural assemblies 105A. For example, structural assembly 105A (e.g., a full-size block) may measure 8" tall by 14" wide by 6' long and may weigh about 40 pounds (e.g., when structural members 125A may be switchgrass stalks). Any other suitable dimensions and materials may be used.

In at least some exemplary embodiments, structural assembly 105A may be made of switchgrass and may have an insulative value of about R-35 (e.g., 35 square foot degree Fahrenheit hours per British thermal unit, also written as SF-deg.F-h/Btu, or R-) including surface air film resistances, and an elastic limit in compression of about 159 pounds per square inch (psi). For example assuming a factor of safety of three and a typical story load of 1,400 pounds per linear foot (plf) of wall, structural assembly 105A may bear the compressive load of a six-story building. Additionally, structural assembly 105A may be made of *miscanthus* giganteus stalks and may have an R-value of about R-32 and a compressive strength of approximately 550 psi such that, with the above-mentioned safety factor and story load, structural assembly 105A may bear a compressive load equivalent to 22 stories. Moreover, structural assembly 105A may be resilient and have significant residual strength beyond the elastic limit which may serve to protect human life during catastrophic events such as earthquakes.

FIG. 4B illustrates a close-up perspective of system 100A (e.g., a wall) in which end portions of structural members 125A may be visible through a fiber mesh sheet 115A. The fiber mesh sheet may be an attachment layer used to make the block and to hold the block together before mortaring. A plurality of joints 155A, similar to the joining method shown in FIG. 3J, may join structural assemblies 105A together. Joint 155A may, alternatively, be any suitable joint such as, for example, the exemplary disclosed block joining techniques illustrated in FIGS. 3F through 3J and also the exemplary disclosed mechanical bond methods described below (e.g., in combination with materials of attachment layer). For example, joint 155A may not yet have been applied to the top surfaces of the top structural assemblies 105A (e.g., at a construction site) as illustrated. Joint 155A may be between about 1 mm and about ¾" thick (e.g., or more or any other suitable thickness) and may cover some or substantially all of a face of structural assembly 105A.

System 100A may be a wall or other structure that may be finished on an interior and/or exterior side with a plaster of earth, gypsum, lime, and/or other suitable material, alternatively may be pre-finished with such material, or may be left with structural members 125A exposed (e.g., stalks exposed as a natural finish). When structural members 125A are to be finished, structural members 125A (e.g., stalks) having rough (e.g., toothy, bumpy and/or wettable, e.g. hydrophilic, epidermis, or skin) stalk surfaces may be useful for bonding plasters. When a natural finish is to be used, structural members 125A that may be smooth stalks with clean, waxy, pleasing appearances such as miscanthus or corn stalks may be suitable.

System 100A including structural assemblies 105A may be stiffer than strawbales used in strawbale construction and straw blocks. Structural assemblies 105A may have an elastic modulus in compression of about 148,000 psi, which may be 148 times greater than that of super-compressed strawbales or straw blocks. The rigidness or rigidity of the exemplary disclosed biocomposite material may provide a firm plaster base for plaster finishes allowing them to be applied more thinly than for strawbale and other materials. Earth plaster finishes, which may range from 1,000 to 2,400 psi in compression elastic modulus, may be more flexible than structural assemblies 105A, which may help to prevent cracking of the finish. For example, a finish 160A (e.g., a braced, crack-resistant finish plaster) of system 100A may serve as an airtight layer when combined with airtight joining material (e.g., such as fabric-backed acrylic tapes) at joints with dissimilar materials including at window frames, concrete foundations, and/or other materials. Finish 160A may also serve as a wind tight layer and a water resistive barrier. Because structural assemblies 105A may have relatively precise dimensional tolerances, finish 160A (e.g., a plaster layer) may be applied in a single thin coat of about ⅛ inch or ¼ inch thickness or any other suitable thickness. Finish 160A may have a thickness that may substantially avoid the addition of significant moisture load to a structure (e.g., a building) supported by system 100A during construction, which may reduce mold risk within the building and save significant time, labor and cost. Further, inexperienced builders may also produce a pleasing finish 160A based on the exemplary disclosed features of system 100A.

System 100A including structural assemblies 105A may be slightly compressed lengthwise (e.g. perpendicular to stalk length) when a flexible end member (e.g. face sheet or attachment layer) is used in order to fit them into place, thus enabling slight onsite adjustments without involving cutting. Because both structure and insulation may be included in the same material of structural assemblies 105A, additional time may be saved in construction of system 100A. By reducing a number of construction steps involved, system 100A may also improve a likelihood that a construction sequence may be followed correctly and may thereby reduce mistakes and callbacks to make repairs. These factors may help to reduce an installed cost. Also in at least some exemplary embodiments, the material of system 100A may provide several hours of fire resistance due to the charring ability of dense natural fibers when arranged so as to prevent the influx of air during burning. This may be achieved without added fire chemicals, which may avoid toxicity of those materials as well as improve end-of-life reuse, recycling and composting.

Figure 4C:
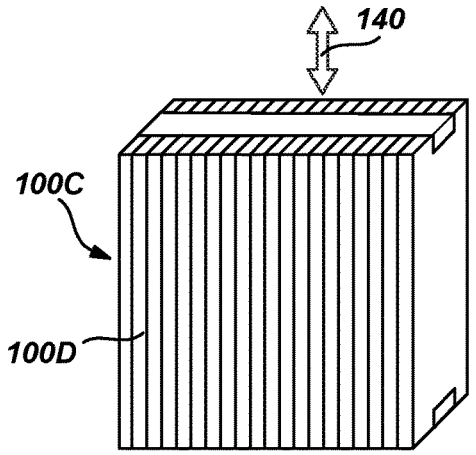
Figure 4D:
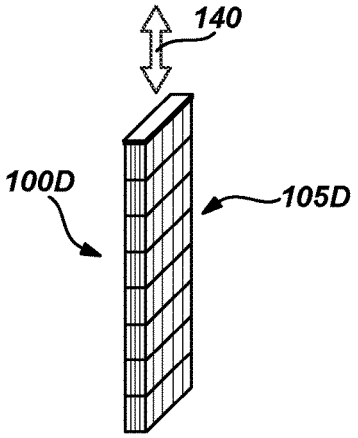

FIG. 4D illustrates another exemplary embodiment. System 100D may be a vertical panel or a column (e.g., of any suitable dimensions such as 6 inches wide by 16 inches deep by 8 feet tall) comprising a plurality of structural assemblies 105D that may be similar to structural assembly 105 (e.g. of any suitable dimension such as 6 inches wide by 16 inches deep by 12 inches tall) using any suitable joining technique such as described herein, such as for example, a prefabricated connection similar to that in FIG. 3H. System 100D may alternatively be a cylindrical or have any other cross sectional shape.

FIG. 4C illustrates another exemplary embodiment. System 100C may be an insulating, load-bearing wall comprised of vertical panels 100D (e.g. as also shown in FIG. 4D) held together with a top and bottom plate. Wood plates are shown in the figure but may alternatively be metal or horizontal mortar beds. Alternatively, said vertical panels may be held together with any other suitable technique such as a plurality of horizontal bolts or dowels, vertical mortar joints or surface bonding the panels together.

Figure 4E:
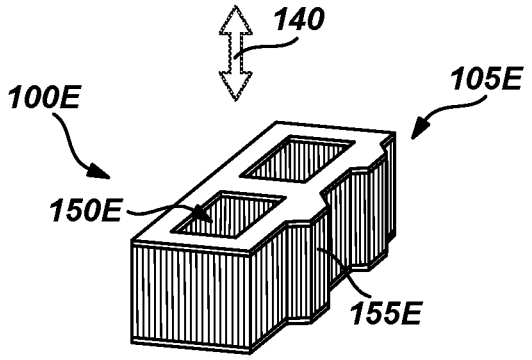
FIG. 4E is a perspective view of a system of structural assemblies including a block with interior voids in accordance with an exemplary embodiment.

FIG. 4E illustrates another exemplary embodiment. System 100E may include structural assemblies 105E that may be similar to structural assembly 105 and that may be blocks with interior holes or voids 150E (e.g., that may be filled with insulation, concrete, reinforcing or other material) and exterior protrusions 155E that may serve as a rainscreen to help drain water from the exterior.

Figure 4F:
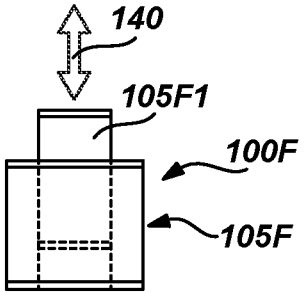
FIGS. 4F and 4G are schematic and perspective views of a system of structural assemblies including a block with moveable core blocks in accordance with an exemplary embodiment.
Figure 4G:
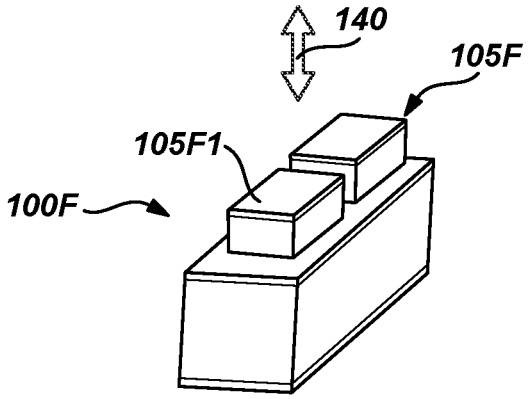

FIGS. 4F and 4G illustrate another exemplary embodiment. System 100F may include structural assemblies 105F that may be similar to structural assembly 105 and that may be blocks with moveable core blocks 105F1 (e.g., that provides interlocking with other blocks when stacked and also compactness for shipping purposes).

Figure 4H:
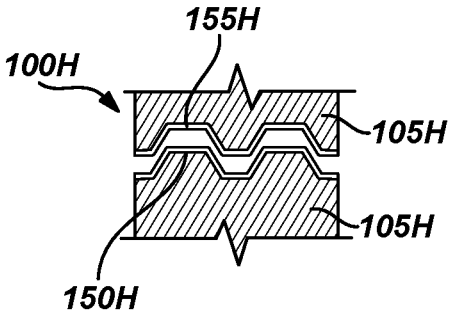
FIGS. 4H and 4I are schematic and perspective views of a system of structural assemblies including variations of interlocking joints between structural assemblies in accordance with exemplary embodiments.

FIG. 4H illustrates another exemplary embodiment. System 100H may include structural assemblies 105H that may be similar to structural assembly 105 and that may include interlocking joints created by protrusions 150H and grooves 155H between two adjacent block faces.

Figure 4I:
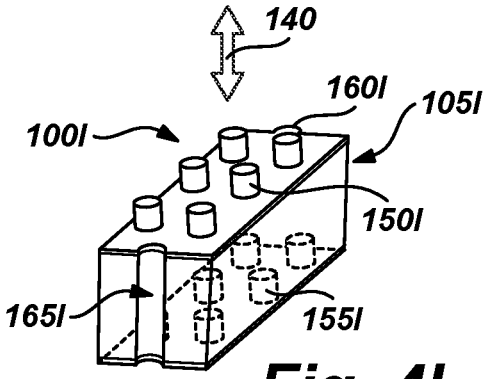
Figure 4J:
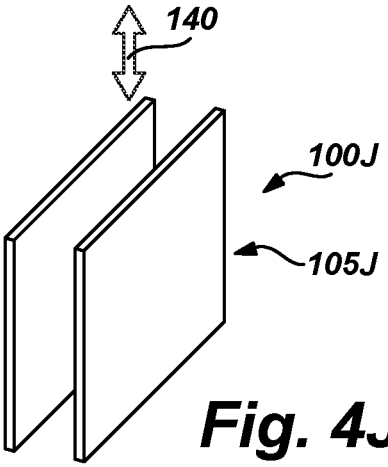

FIG. 4I illustrates another exemplary embodiment. System 100I may include structural assemblies 105I that may be similar to structural assembly 105 and that may be blocks with rod-like protrusions 150I for interlocking stacked blocks having recesses 155I to receive the protrusions as well as protrusions 160I and channels 165I for interlocking the ends of blocks.

Figure 4K:
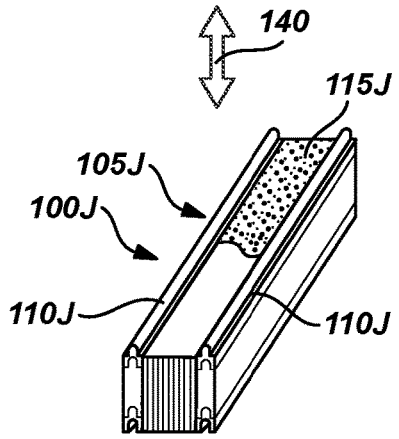
Figure 4L:
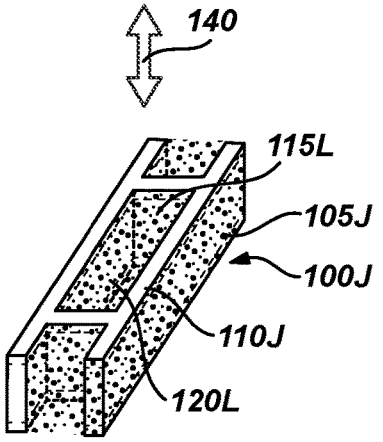
Figure 4N:
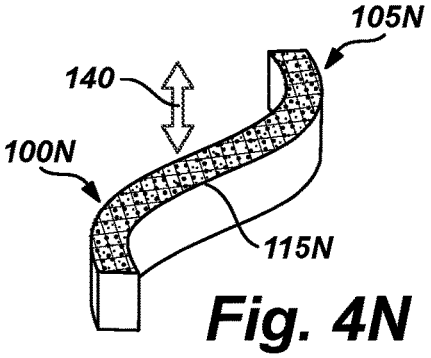
Figure 4M:
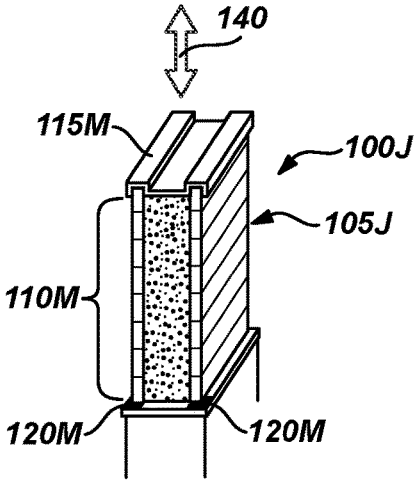

FIGS. 4J, 4K, 4L, and 4M illustrate another exemplary embodiment. System 100J may include structural assemblies 105J that may be similar to structural assembly 105 and that may include a cavity wall or spaced-apart wall with load-bearing external leaves that may be filled with insulation. For example, FIGS. 4K to 4M show a range of components and variations for making such a cavity wall. FIG. 4K illustrates insulated logs (e.g. a long block) with load bearing edges 110J and a central portion 115J made of stalks of a different plant type. FIG. 4L illustrates insulated blocks with load bearing edges 110J that are tied together with webs 115L and filled with loose insulation 120L. FIG. 4M illustrates leaves 110M made up of vertical panels (e.g., each being 2 inches thick by 16 inches wide by 8 feet tall or any other suitable dimensions) each comprising a plurality of structural assemblies 105J and attached together (e.g., tied together with a continuous top 115M and individual bottom plates 120M).

FIG. 4N illustrates another exemplary embodiment. System 100N may include structural assemblies 105N that may be similar to structural assembly 105 and that may form a curved wall with an adhered flexible mesh on top 115N and bottom that may allow the construction of a curved wall once mortared into place.

Figure 4O:
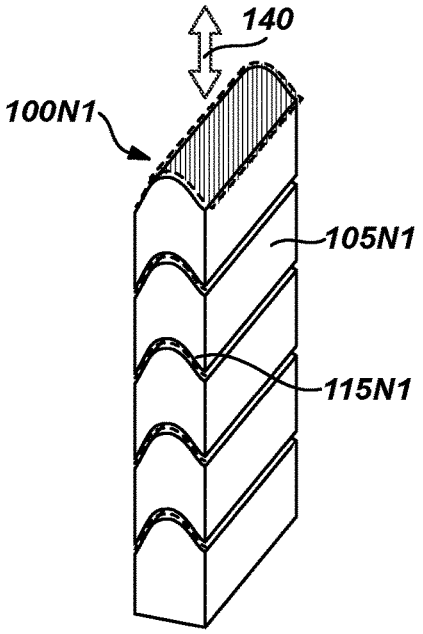

FIG. 4O illustrates another exemplary embodiment. System 100N1 may include structural assemblies 105N1 that may be similar to structural assembly 105 and that may form a garden wall, noise barrier or fence made of weather durable stalks such as *Miscanthus giganteus* with an intervening drainage layer 115N1 acting as a block face (e.g. similar to end member 115).

In at least some exemplary embodiments, blocks similar to structural assembly 105 may weigh about 40 pounds and have different dimensions due to a different type of stalks used (e.g., miscanthus, switchgrass, corn, and sorghum). 40 pounds may be a desirable lifting weight for construction. A panel may include full-height stalks that may be as tall as a wall and do not involve intervening end members or layers (e.g., in which structural members 125 may be willow, kenaf, hemp, miscanthus, Arundo giant reed, bamboo or other tall stalk). Girding ties or tension straps may encircle the full-height stalks at intermediate heights so as to prevent them from bowing or buckling under load. Some exemplary dimensions of convenient weight may include a 6 inch tall by 16 inch wide by 8 feet long block that may be made of switchgrass, and a 12 inch tall by 16 inch wide by 24 inch long block and a 8 inch tall by 16 inch wide by 32 inch long block that may be made of *Miscanthus giganeteus*. In other exemplary embodiments, a system similar to system 100 may be a prefabricated mass wall panel (e.g., sized 1' wide×8' tall×26' long) composed of horizontal blocks that may be similar to structural assembly 105 and pre-finished with a drainage plane, siding and interior plaster that may be shipped in a truck and lifted into place using for example a crane (e.g., or a large prefabricated wall panel oriented such that the long dimension is several stories high and the width is 8 feet or any other desired dimension).

In at least some exemplary embodiments (e.g., and as another example of a block joining technique), blocks similar to structural assembly 105 may be stacked and held together by different techniques. The blocks may be surface bonded together with a fibered mortar. Further, blocks may be bonded by growing mycelium between them. For example, a top layer of each block may have a dormant mycelium that may begin to grow when dampened and put into place, thus forming a structural bond as well as an airtight seal.

Figure 4P:
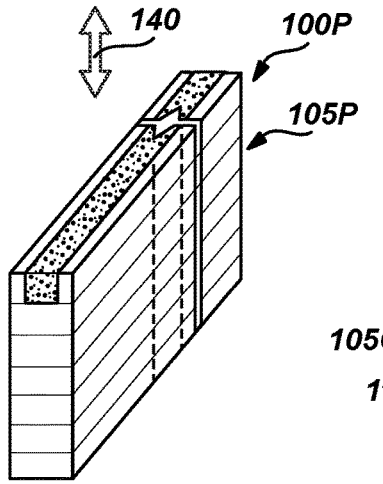

FIG. 4P illustrates another exemplary embodiment. System 100P may include one or more structural assemblies 105P that may be similar to structural assembly 105. System 100P may be prefabricated wall panels with vertical and horizontal grooves at the top and end edges of the panel shaped in a way to allow concrete columns and beams to be poured once the panel is set in place (e.g., with a crane).

FIGS. 4Q1 and 4Q2 illustrate other exemplary embodiments. System 100Q may include one or more structural assemblies 105Q that may be similar to structural assembly 105. System 100Q may include insulated concrete forms (ICF) that may be stacked and then used as formwork for a concrete structure 110Q. The concrete structure may be located to one side, as shown in FIG. 4Q2 (e.g., with the help of a fabric form layer 130Q held in place like a dimpled quilt during pouring) or as shown in FIG. 4Q1 (e.g., in between two insulation layers).

Figure 4R:
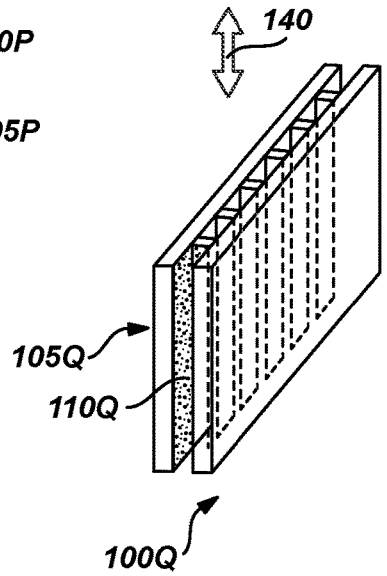
Figure 4R:
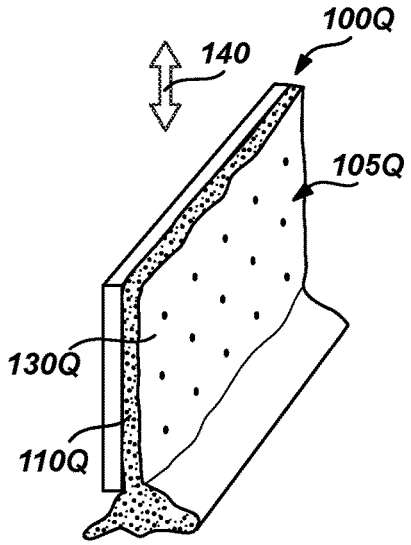
Figure 4R:
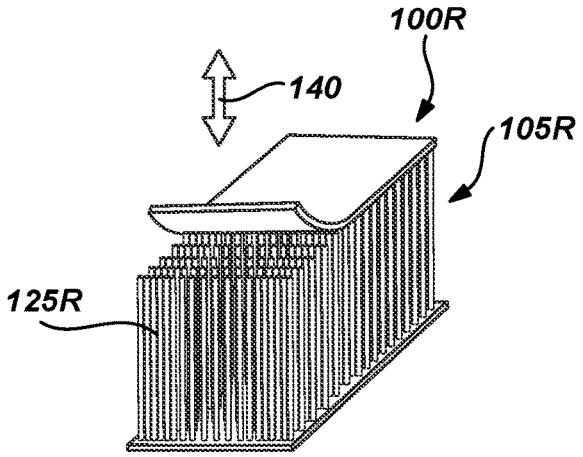

FIG. 4R illustrates another exemplary embodiment. System 100R may include structural assemblies 105R that may be similar to structural assembly 105 and that may include structural members 125R that may be similar to structural members 125 and that may be stalks disposed in a range of densities (e.g., increasing in density from the inside toward the outside of structural assembly 105R). For example, the density of structural members 125R may vary in a different spatial arrangement or may have a discrete or hard cutoff between zones of different density.

Figure 4S:
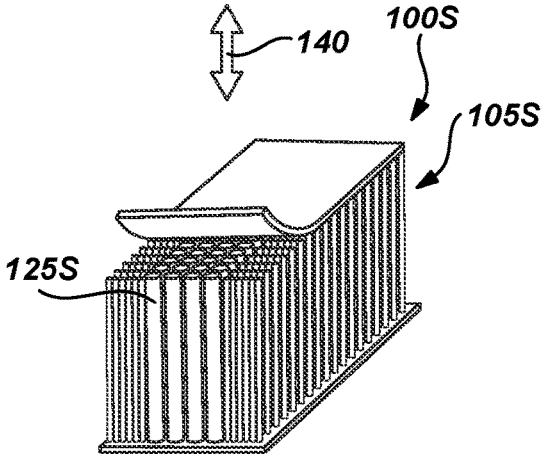

FIG. 4S illustrates another exemplary embodiment. System 100S may include structural assemblies 105S that may be similar to structural assembly 105 and that may include structural members 125S that may be similar to structural members 125 and that may be stalks of different plant types. For example, thick corn stalks may be disposed in the center and thin switchgrass may be disposed toward the exterior as shown. Different plant types may be separated into different zones or be interspersed. For example, structural members 125S may be of different plant types that may serve different functions (e.g., switchgrass may be suitable for supporting finish plasters, thicker stalks located at outer surfaces may provide greater stiffness, and corn stalk may be lightweight so that panels may be larger and involve less installation labor).

Figure 4T:
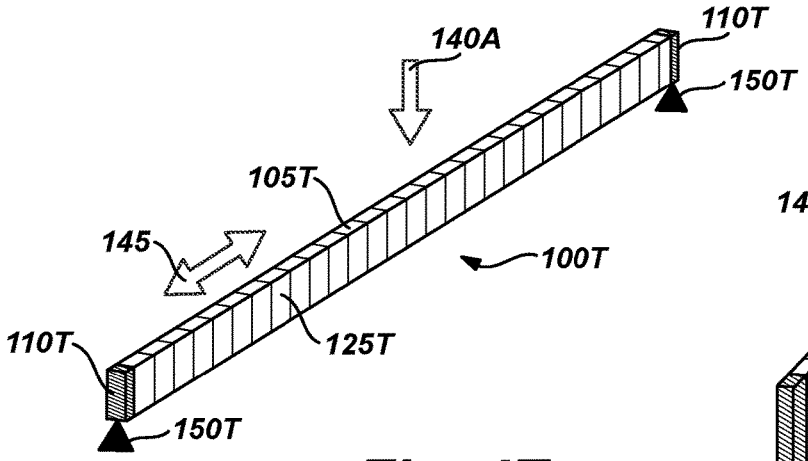
FIGS. 4T through 4V are perspective views of a variety of systems of structural assemblies including spanning members in accordance with additional embodiments.
Figure 4U:
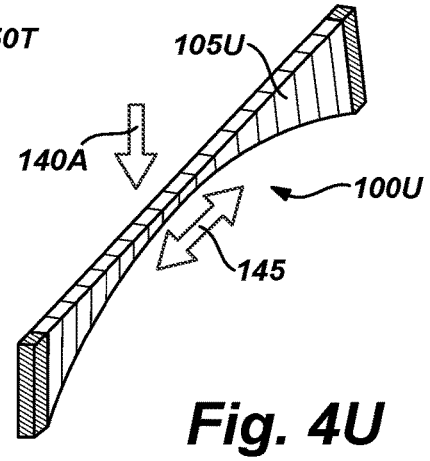
Figure 4V:
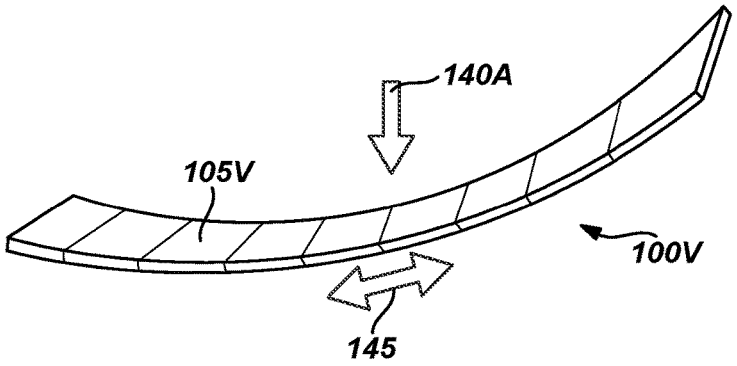

FIGS. 4T through 4V illustrate perspective views of spanning members (e.g. roofs, floors, beams, or planks) having structural members 125T (e.g., stalks) oriented parallel to the length of the spanning member and perpendicular to the thickness of the spanning member. The spanning members may be loaded with a load direction 140A (e.g. a gravity load) that is perpendicular to span (e.g. rather than being primarily axial as in walls). These exemplary disclosed spanning members may resist tensile and compressive stresses along their length in direction 145 which is parallel to the length of structural members or stalks.

FIG. 4T illustrates an exemplary embodiment. System 100T may include structural assemblies 105T that may be similar to structural assembly 105 and that may form a floor plank (e.g., 3 inches wide by 12 inches deep by 24 feet long) made of miscanthus and weighing 80 pounds (e.g., to be lifted by two people) for example with solid wood bearing blocks 110T at either end shown on supports 150T.

FIG. 4U illustrates another exemplary embodiment. System 100U may include structural assemblies 105U that may be similar to structural assembly 105 and that may form a floor or roof arch that places structural assemblies 105U (e.g., blocks) primarily in compression, thereby avoiding tensile loads. Direction 145 follows the shape of the arch and is parallel to stalk length.

FIG. 4V illustrates another exemplary embodiment. System 100V may include structural assemblies 105V that may form a long-span tensile roof panel (e.g., 4 feet by 52 feet) that may rest in a parabolic curve when in use. Structural assemblies 105V may be tension (e.g., tension-only) members that may provide an efficient use of material. The thickness of structural assemblies 105V (e.g., panels) may provide stabilization of a roof under variable environmental loading such as wind loads as well as insulation. Long stalk lengths of structural assemblies 105V may be used as a risk of stalk buckling may be low. In some exemplary embodiments, the stalks may be the full length of the span. Direction 145 follows the shape of the curve and is parallel to stalk length.

Figure 8A:
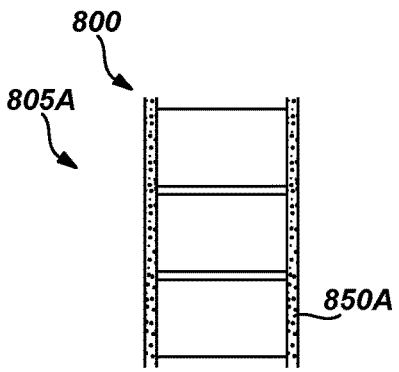
Figure 8D:
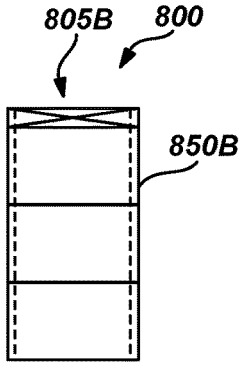
Figure 8D:
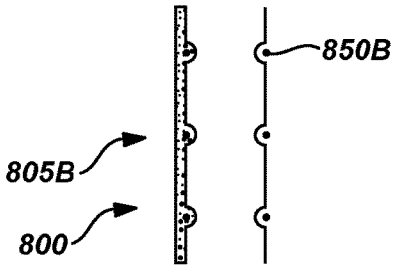
Figure 8D:
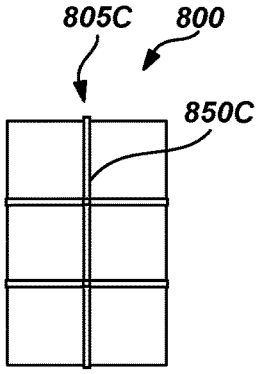
Figure 8D:
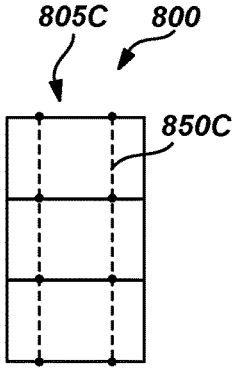
Figure 8D:
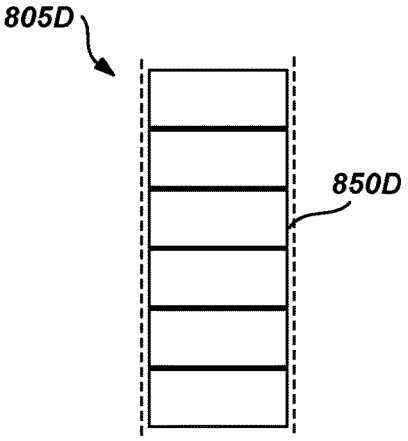
Figure 8F:
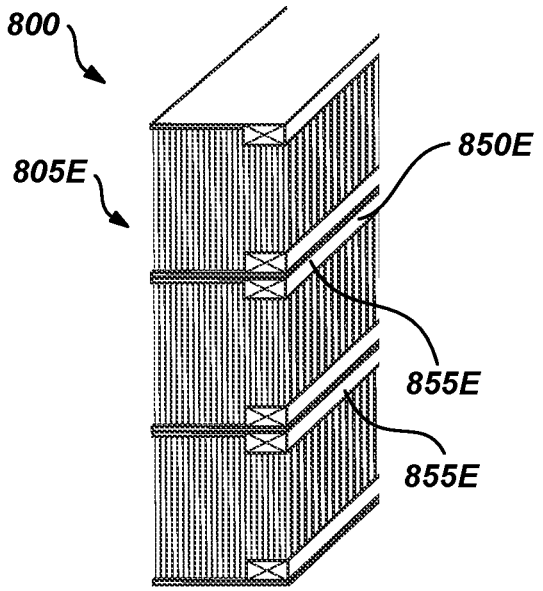
Figure 8F:
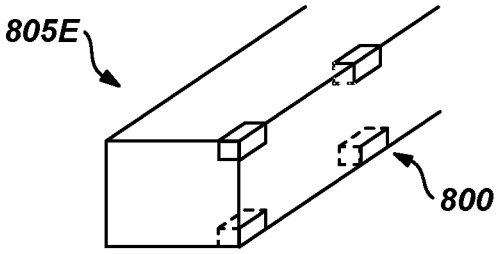
Figure 8F:
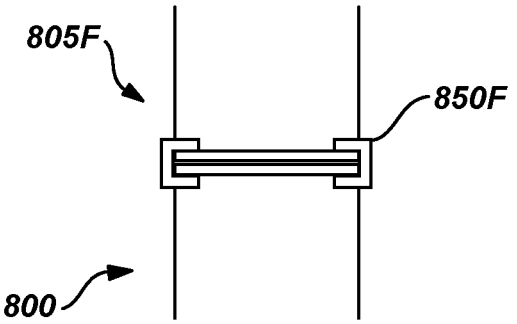
Figure 8G:
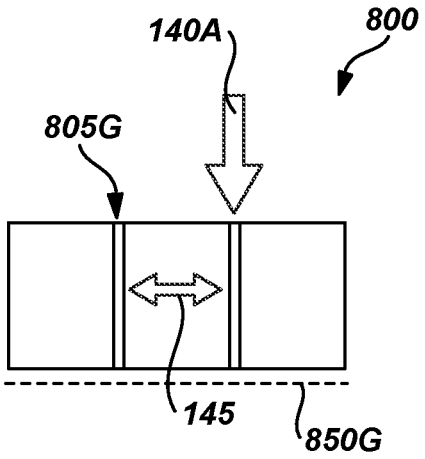

FIG. 8G illustrates a section of a spanning member with structural assemblies 805A and a tension layer or tension member 850G attached on the lower side of the member or the side facing the ground. When under load, the blocks primarily resist compressive stresses and the tension face resists tensile stresses in direction 145. This configuration may permit relatively weak (e.g. cost effective) adhesive block joining methods such as mortar bonds to be useable for spanning members. In another exemplary embodiment, a spanning member such as for a long span roof may utilize a tension member that takes on a parabolic shape while the compression blocks are shaped so as to fill in the dip of the curve such that no joining method may be involved between the compression blocks or between the compression and tension members except at supports.

In at least some exemplary embodiments, blocks similar to structural assembly 105 may provide a section of a composite floor with a top compression member being site-cast concrete and a bottom tension member comprising one or more assemblies similar to structural assemblies 105 (e.g., stalk blocks). An embedded shear plate may be used to join the two parts.

Figure 5:
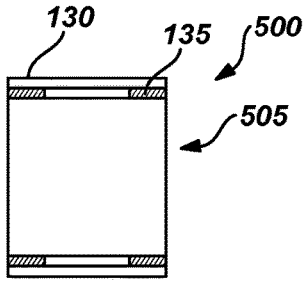
FIG. 5 is a side view of an exemplary embodiment of the present invention.
Figure 6B:
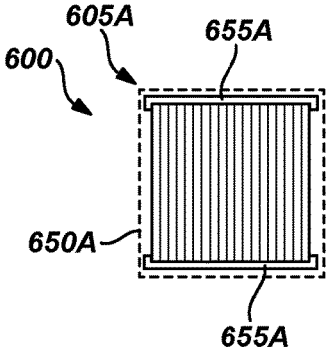
Figure 6B:
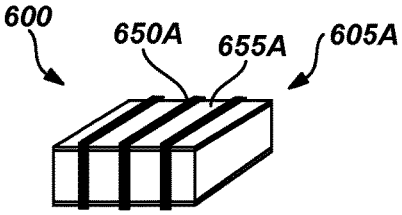
Figure 6B:
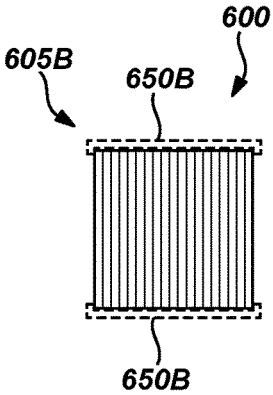
Figure 6C:
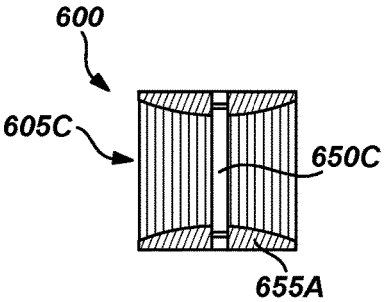
Figure 6D:
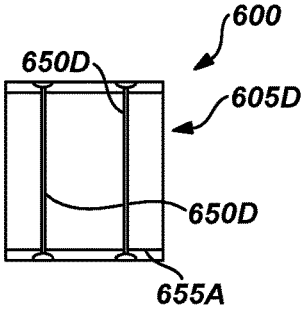

FIG. 5 illustrates another exemplary embodiment. System 500 may include structural assemblies 505 that may be similar to structural assembly 105. The shape of structural assemblies 505 (e.g., the load resisting element) may be maintained without fastening all of the stalk ends to the face layers (e.g., layers similar to end members 115 and 120). For example, a portion of those stalks at the edge may be adhered with attachment layer 135 and substrate layer 130 as shown in FIG. 5.

FIGS. 6A1, 6A2, 6B, 6C, and 6D illustrate additional exemplary embodiments including various configurations of attachment between structural members 125 and end members 115 and 120. System 600 may include structural assemblies 605A, 605B, 605C, and 605D that may be similar to structural assembly 105. Rigid face layers or face plates 655A that may be similar to end members 115 and 120 may be connected to the stalk ends of the exemplary disclosed structural assemblies without adhesive by tightly compressing the rigid face plates against the stalk ends and holding them in place using girding straps 650A that encircle the face plates (e.g., as illustrated in side and perspective views FIGS. 6A1 and 6A2), and/or bolts 650C and 650D that pass between plates (e.g., as illustrated in side views FIGS. 6C and 6D), such that the pre-compressed stalks are held in place by friction against the face plates at their ends. Alternatively, a flexible face layer 650B may be fabric that tightly wraps four or more sides of the block such that the stalks are pressed together and against the face layers (e.g., as illustrated in side view FIG. 6B). System 600 may include a joining technique that may be both dry and reversible and that provides for easy disassembly as well as recycling or composting of component parts.

Figure 7A:
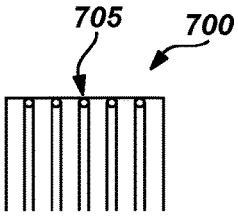
FIGS. 7A and 7B are close-up side and bottom views including a technique for joining that permits water to escape in accordance with an exemplary.
Figure 7B:
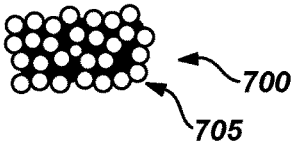

FIGS. 7A and 7B illustrate another exemplary embodiment. System 700 may include structural assemblies 705 that may be similar to structural assembly 105. FIGS. 7A and 7B illustrate a technique for joining stalks to face layers that may both seal the ends of the stalks of structural assembly 705 and may join the stalks at points (exaggerated gaps shown) leaving the bulk of the space between stalk ends open such that the material may be free-draining or permit to water to escape.

FIGS. 8A, 8B1, 8B2, 8C1, 8C2, 8D, 8E1, 8E2, 8F, and 8G illustrate additional exemplary embodiments. System 800 may include structural assemblies 805A, 805B, 805C, 805D, 805E, 805F, and 805G that may be similar to structural assembly 105. The exemplary disclosed structural assemblies may be dry stacked blocks that may be held together by a variety of techniques. For example as shown in side view FIG. 8A, surface-bonding cement 850A may coat two opposing faces of structural assembly 805A with or without embedded tension layers. (For example, such a method may incorporate fabric mesh, which when used as a tension layer may be made structurally continuous between blocks using a variety of configurations. For example, the fabric mesh may drape over a block in an upside-down U-shape such that the loose ends lap over the lower block. Also for example, the fabric mesh may be disposed at the bottom face layer of a block and may wrap over the top corners of the block below. Also for example, pre-finished blocks may be provided with mesh embedded in said finish lapping from an upper block to the block below). The exemplary disclosed structural assemblies may be dry-stacked blocks that may also be held together by applying pressure to the structural assemblies using a series of (e.g., surface-mounted or indented) tension layers or tension ties 850B made of twine, straps, furring strips or wires (e.g., as illustrated in FIGS. 8B1 and 8B2); by embedded dowels, threaded rod, or bolts 850C (e.g., as illustrated in FIGS. 8C1 and 8C2); and/or by one or more tension layers 850D for example of fabric, wire mesh, or similar device (e.g., as illustrated in FIG. 8D). Also for example, dry-stacked blocks may be connected via fastening embedded wood blocks 850E together with dowel type fasteners (e.g., fasteners 855E as illustrated in FIGS. 8E1 and 8E2), and/or by fastening adjacent wood face layers of adjacent blocks with mechanical fasteners such as clips 850F, or screws, nails, and/or bolts (e.g., as illustrated in FIG. 8F). Further for example, adjacent blocks may each have their own separate face and may be joined together with an intervening adhesive such as mortar or a variety of other bonding agents. For example, when an adhesive is used that may be weaker than that used to bond a block face to the stalk ends, the assembly may be more easily demounted and the components reused (e.g., the same may be true for dry-stacked blocks).

Figure 9F:
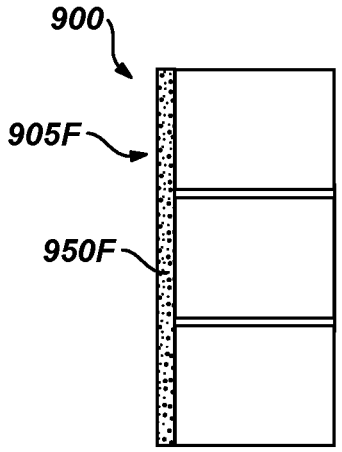
Figure 9G:
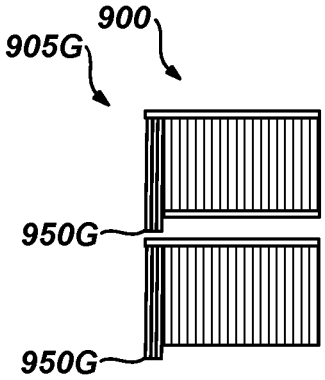
Figure 9H:
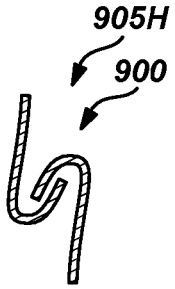

FIGS. 9A, 9B, 9C, 9D, 9E1, 9E2, 9F, 9G, and 9H illustrate additional exemplary embodiments. System 900 may include structural assemblies 905A, 905B, 905C, 905D, 905E, 905F, 905G, and 905H that may be similar to structural assembly 105. System 900 may include a water resistive barrier (WRB) that may be incorporated on the exterior surface of the blocks (e.g., structural assemblies 905A, 905B, 905C, 905D, 905E, 905F, 905G, and 905H) such that the WRB is continuous or laps over the block below it. A prefabricated WRB sheet layer may be adhered to the exterior surface, partially or fully bedded in clay plaster (e.g., as illustrated in FIG. 9B) or similar material, and/or draped over the outer edge of the block with the top edge of the WRB being clamped between adjacent blocks. Alternatively for example as shown in FIG. 9F the WRB may be formed on-site as a continuous fluid-applied layer of earth plaster 950F or other type of non-toxic coating with or without an embedded drainage sheet. For example as shown in FIG. 9G, the WRB may be formed using the stalks themselves, for example using plant species with a hydrophobic epidermis or water tolerant composition such as miscanthus, corn, rice, reed, cattail and/or any suitable typha species. The outermost stalks may be formed into a drip edge 950G that may lap over the lower block in order to shed wind-driven rain that may make its way through the exterior wall finish. Alternatively for example as illustrated in FIG. 9A, a flexible water-resistive barrier layer 950A may be lapped in shingle fashion and pre-attached to the block (blocks may be demountable). For example as illustrated in FIG. 9C, pre-fabricated clay WRB 950C with flexible embedded WRB strip 955C may be used at lap joints. As illustrated in FIG. 9D, bent flexible WRB 950D may be held in place by friction between blocks. As illustrated in FIGS. 9E1 and 9E2, flexible WRB may be sewn, stapled, or taped at laps. As illustrated in FIG. 9H, WRB may be rolled or interlocking. Several of these WRB techniques also may form a windtight layer or airtight layer to prevent air infiltration through the system.

Figure 10A:
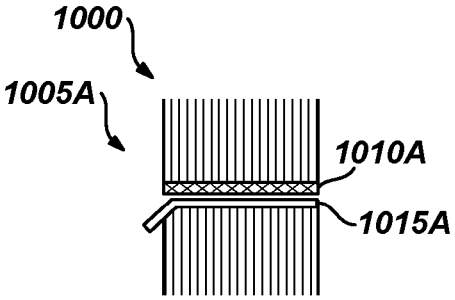
FIGS. 10A through 10C are side views of a system of structural assemblies including various water drainage techniques in accordance with exemplary embodiments.
Figure 10B:
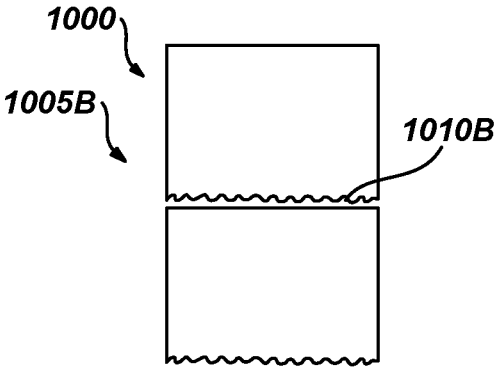
Figure 10C:
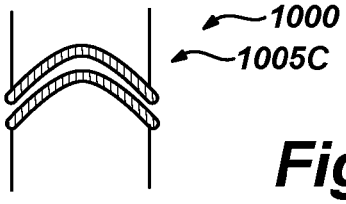

FIGS. 10A, 10B, and 10C, illustrate additional exemplary embodiments. System 1000 may include structural assemblies 1005A, 1005B, and 1005C, that may be similar to structural assembly 105. System 1000 may provide for additional drainage efficiency of wind-driven rain, which may be achieved using free draining face layers. A bottom face layer of an upper block may provide a free draining layer (e.g. similar to that in FIGS. 7A and 7B). A bottom face layer may have only a portion that is free-draining. Additionally, the bottom face layer may include protrusions (e.g., be rough or bumpy) such that capillary suction may be avoided (e.g., a face layer 1010B for example as illustrated in FIG. 10B). The upper face of the lower block may be composed of or covered by a waterproof layer. The waterproof layer may be sloped to aid drainage from the interior of the block. For example as illustrated in FIG. 10A, a bottom face layer 1010A may be pervious (e.g., such as an aerated cementitious material, a geotechnical fabric drainage layer, a stainless steel mesh, or an oil-treated burlap material). System 1000 may also include a layer 1015A that may be a waterproof top face layer (e.g., sloping all or in part) for example as illustrated in FIG. 10A. A top and bottom face may be sloped in part or substantially entirely sloped (as in FIG. 10C).

Figure 11A:
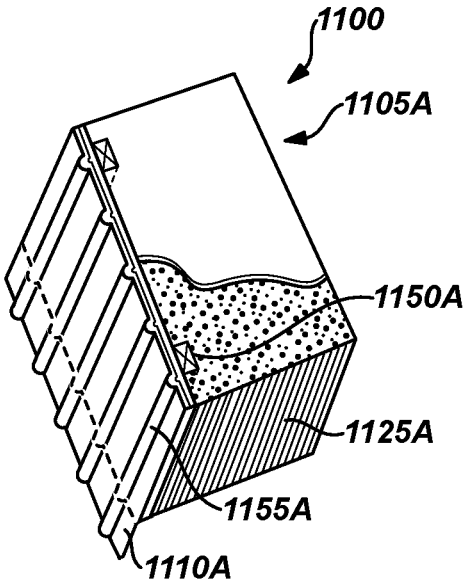
FIGS. 11A and 11B are perspective and side views of a system of structural assemblies including configurations of a rainscreen air gap in accordance with exemplary embodiments.
Figure 11B:
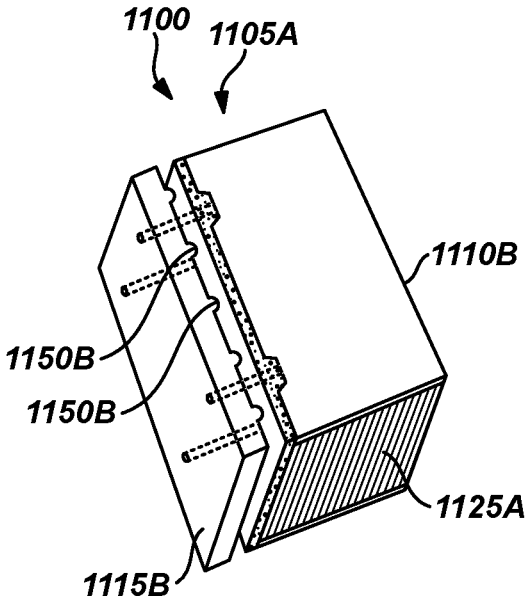

FIGS. 11A and 11B illustrate an additional exemplary embodiment. System 1100 may include a structural assembly 1105A that may be similar to structural assembly 105. System 1100 may include a rainscreen air gap between siding and an assembly of structural assemblies (e.g., blocks) by attaching the siding to furring strips, brick ties, or other fastening points. System 1100 may provide an exterior insulated wall with an integral rain screen, an external insulation finishing system (EIFS), and/or a free-standing external thermal insulation composite system (ETICS) for example for super-insulated building renovations or deep energy retrofits. System 1100 may include structural members 1125A that may be similar to structural member 125.

For example as illustrated in FIG. 11A, wood blocks 1150A may be included in the stalk layer of the block providing a nailing base for siding (not shown for clarity). As illustrated in FIG. 11A, system 1100 may include a layer 1110A that may be a WRB comprised of fabric embedded in veneer clay plaster layer with integrally formed linear ridges 1155A. For example as illustrated in FIG. 11B, blocks may be shaped such that grooves are formed on the exterior face (e.g., these block indents may be used to form lines or points of thickened plaster which may, in turn, be used as fastening points for siding). For example as illustrated in FIG. 11B, system 1100 may include a groove 1110B in the block that may be filled with plaster to fasten a siding 1115B into. Siding 1115B may be a mineralized stalk siding similar to structural assembly 105 with an integral rainscreen 1150B (e.g., bumps may be facing air gaps and WRB).

FIGS. 12A, 12B, 12C, and 12D illustrate additional exemplary embodiments. System 1200 may include structural assemblies 1205A, 1205B, 1205C, and 1205D that may be similar to structural assembly 105.

Figure 12A:
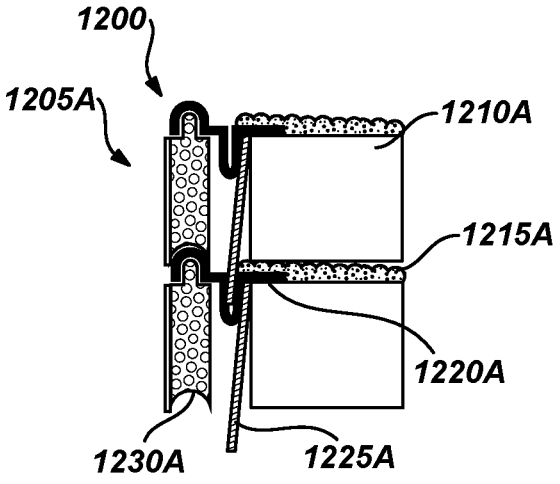
FIGS. 12A through 12D are side and perspective views of a system of structural assemblies including configurations of a rainscreen air gap of exemplary embodiments.
Figure 12B:
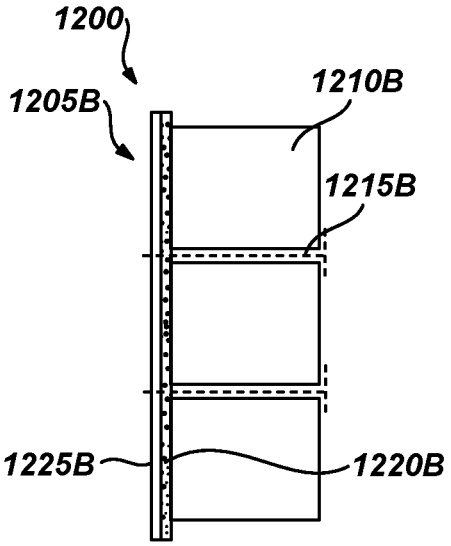
Figure 12D:
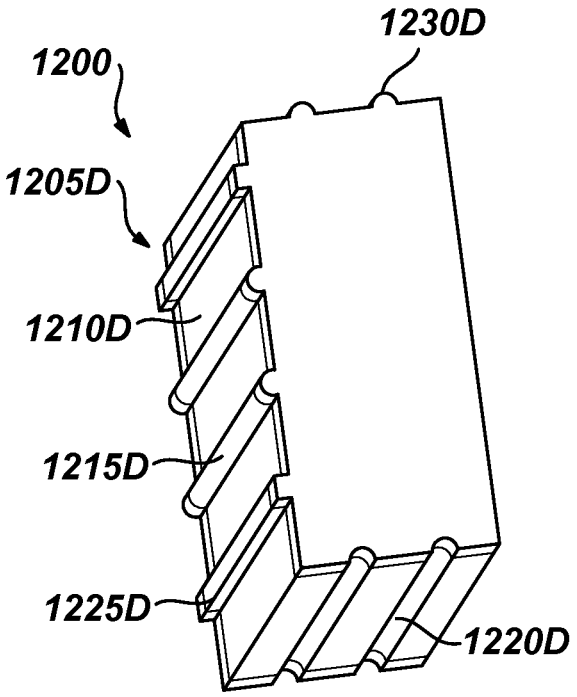

System 1200 may include a rainscreen air gap that may be formed integrally with the blocks with the aligned stalks themselves forming linear ridges (e.g., for example as illustrated in FIG. 12D). System 1200 may include an aligned portion 1210D formed by aligned stalks, a bump portion 1215D that may be a rain screen bump formed by aligned stalks, a positioning groove 1220D to fit with positioning ridge 1230D of an adjacent block, and a nail base 1225D that may be a wood furring or metal furring strip and may be incorporated into the block (e.g., installed interior to water resistive barrier and attached to top and bottom end members similar to 115 and 120).

For example as illustrated in FIG. 12A, system 1200 may include an exterior wall block 1210A, a mortar joint 1215A, a brick tie or gap-spanning tie 1220A set in mortar, a lapped water resistive barrier 1225A, and a stalk-based siding 1230A. An air gap may thereby be formed with spanning ties set in mortar joints, or similar gap-forming fasteners.

Figure 12C:
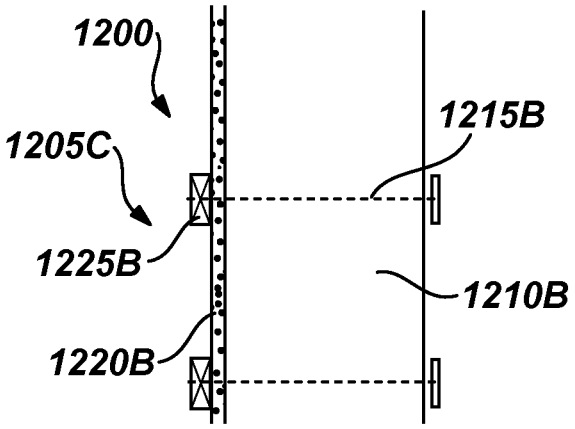

For example as illustrated in FIGS. 12B (side view) and 12C (plan view), a rainscreen gap may be formed with furring strips installed to the exterior of the WRB and held in place by wire ties or similar devices. For example as illustrated in FIGS. 12B and 12C, system 1200 may include an exterior wall block 1210B, a through-tie 1215B (e.g., of wire or twine passed through the wall), a water-resistant layer 1220B (e.g., earth plaster), and a furring strip 1225B (e.g., a metal or wood nail base for siding). Alternatively for example, a rainscreen air gap may be formed on the gap-facing side of a stalk-based or other siding, integrally formed out of plaster ridges in a WRB made of plaster, or formed using WRB sheets with surface bumps or other integral gap-forming devices or techniques.

Figure 13:
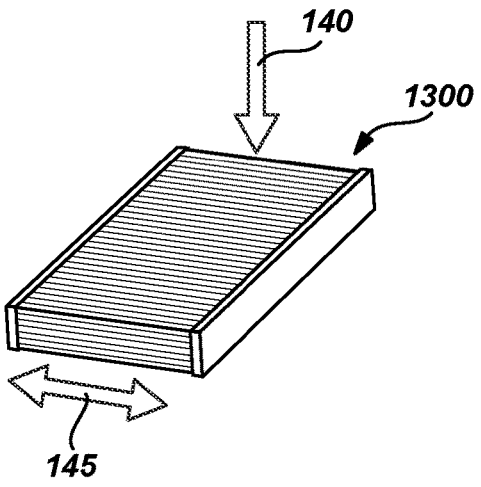
FIG. 13 is a perspective view of a system including a table top in accordance with an exemplary embodiment.
Figure 14:
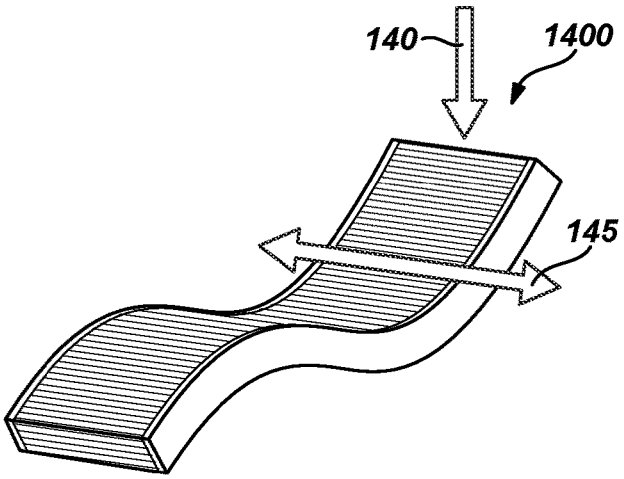
FIG. 14 is a perspective view of a system including a lounge chair in accordance with an exemplary embodiment.

FIGS. 13-16 illustrate additional exemplary embodiments. FIG. 13 illustrates a system 1300 that may be a table top with structural members similar to structural members 125 (e.g., stalks) spanning parallel to the ground. Such a surface may be used for outdoor furniture using highly durable stalks such as miscanthus or corn. FIG. 14 illustrates a system 1400 that may be a lounge chair with curved panel faces (e.g. similar to end members 115 and 120) with structural members similar to structural members 125 (e.g., stalks) forming the sitting surface. These articles may include stalks oriented parallel to span and resist tensile and compressive stresses in direction 145.

Figure 15:
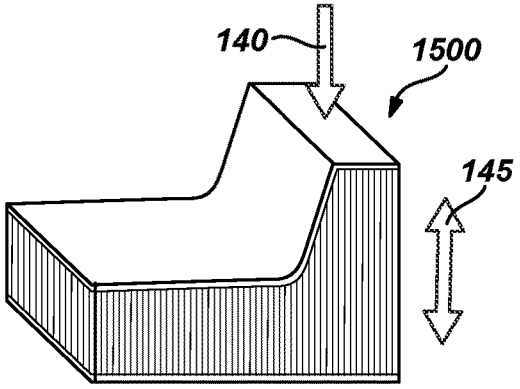
FIG. 15 is a perspective view of a system including a chair in accordance with an exemplary embodiment of the present invention.

FIG. 15 illustrates a system 1500 that may be a chair with structural members similar to structural members 125 (e.g., stalks) running perpendicular to the sitting surface. Stalks may provide the finish material for the sides of the chair. Corn stalks may be used in this application for surface beauty, durability, stiffness, and/or light weight. Such a chair may be ideal for dorm rooms being compostable at end of life.

Figure 16:
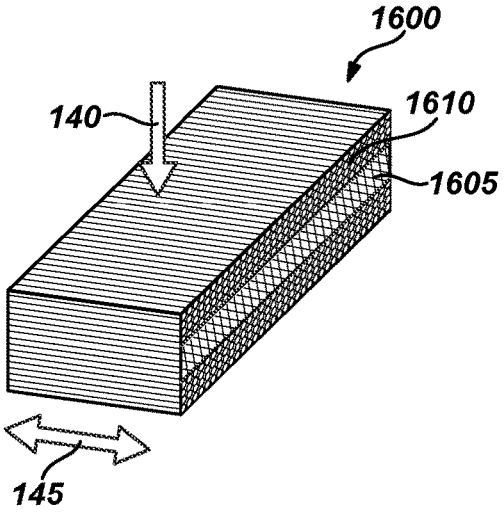
FIG. 16 is a perspective view of a system including a seat cushion in accordance with an exemplary embodiment of the present invention.

FIG. 16 illustrates a system 1600 that may be a section of a cushion structure with rigid panel faces 1605 in the center of the cushion and flexible panel faces 1610 toward the edge of the cushion. System 1600 may provide some give or softness to the surface of furniture such as seat cushions or bed mattresses while also maintaining an intended shape of the article.

Figure 17:
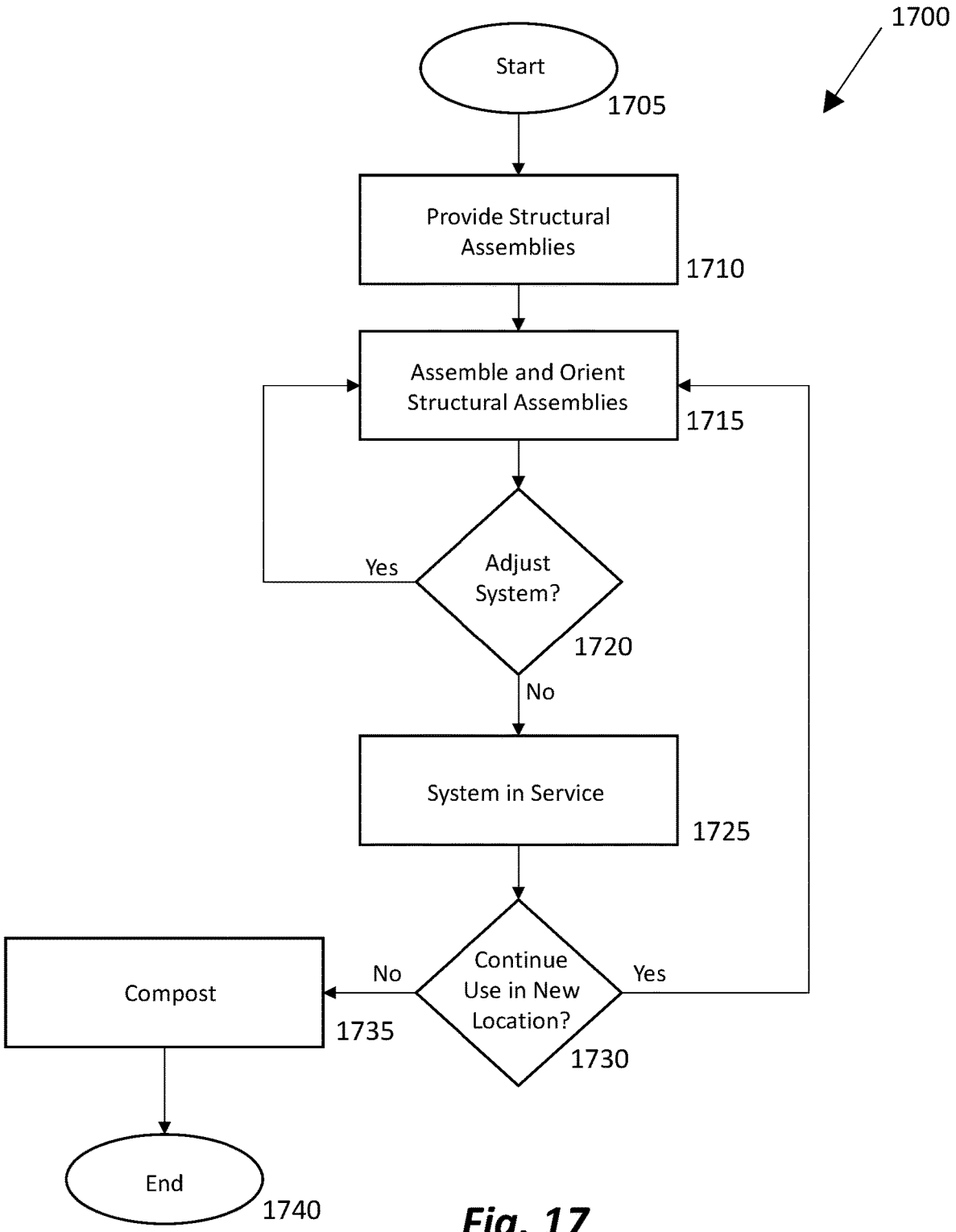
FIG. 17 is a flowchart showing an exemplary process of the present invention.

FIG. 17 illustrates an exemplary operation for using the exemplary disclosed system. Process 1700 begins at step 1705. At step 1710, any of the exemplary disclosed structural assemblies (e.g., structural assemblies 105) may be provided. At step 1715, the exemplary disclosed structural assemblies may be assembled for example as described herein. The exemplary disclosed structural assemblies may be oriented so that the exemplary disclosed structural members (e.g., structural members 125) may have a length or longitudinal direction that may be parallel to direction 145. Structural members (e.g. stalks) parallel to direction 145 may be vertically aligned (e.g. parallel to load direction 140) in axially loaded assemblies (e.g. load bearing walls) and oriented longitudinally (e.g. parallel to span) in spanning members such that, for example in floors, stalks may be perpendicular to a gravity load in direction 140A. Structural members may be aligned in a direction perpendicular to the thickness of the system (e.g. wall thickness or roof thickness). At step 1720, it may be determined whether or not the exemplary disclosed system is to be adjusted. If the exemplary disclosed system is to be adjusted, process 1700 returns to step 1715. If the exemplary disclosed system is not to be adjusted, process 1700 proceeds to step 1725.

The exemplary disclosed system may be used at step 1725 to support load and/or to perform any other suitable function for example as described herein. The exemplary disclosed system may remain in service for any desired time period (e.g., days, months, years, or decades or more). The exemplary disclosed structural members may resist compression and/or tension stresses during service (e.g., parallel to direction 145) for example as described herein.

At step 1730, for example when service at a given location has ended, it may be determined if the exemplary disclosed system is to be used in a new location. If the exemplary disclosed system is to be used in a new location, the exemplary disclosed structural assemblies may be disassembled and moved to a new location, at which process 1700 may return to step 1715 and repeat steps 1715 through 1725. If the exemplary disclosed system is not to be used in a new location, the exemplary disclosed structural assemblies may be, for example if desired, composted (e.g., or discarded) at step 1735. Process 1700 ends at step 1740.

In at least some exemplary embodiments, the exemplary disclosed system, apparatus, and method may serve as minimally load-resisting, self-supporting or nonstructural panels in articles such as rigid insulation, exterior insulation and finish systems (EIFS), siding, insulated concrete forms (ICF), furniture, doors, signage, packaging, theater props, and toys. The exemplary disclosed system, apparatus, and method may serve in several functions that typically rely on slow-growing plants (e.g., wood framing) and/or high-embodied energy or non-renewable materials such as steel (e.g., metal framing or structural steel), cement (e.g., concrete masonry or cast concrete), and/or petroleum-derived foam (e.g., exterior insulation, SIP, ICF, or EIFS). Given that the exemplary disclosed stalks may be renewable, natural materials that produce biomass quickly, the biocomposite may help to meet growing global demand for materials goods while minimizing adverse environmental impacts. Some compositions may be entirely recyclable as nutrients or as nutrients/minerals at the end of their service life. Additionally, some end uses with relatively long lifespans such as building materials, may sequester and/or remove carbon from the atmosphere and may store it for decades, thus helping to address climate change.

In at least some exemplary embodiments, the exemplary disclosed system, apparatus, and method may utilize structural members (e.g., stalks) that may include any number of different plant species from different climates and different ecological niches around the world, which may provide a variety of structural and nonstructural articles made of local resources (e.g., thus improving economical options, resilience, and obviating the need for costly long-distance shipping). Because exemplary disclosed technique for joining (e.g., attachment layer 135 and/or substrate layer 130) may be made of a variety of materials, the exemplary disclosed structural assembly may be adaptable to different types of pre-existing equipment in manufacturing facilities, thus reducing startup capital costs for manufacture. Moreover, because the biocomposite material may be used for a large array of goods, manufacturing capital risk may be further reduced because equipment may be adaptable to multiple products.

In at least some exemplary embodiments, the exemplary disclosed system, apparatus, and method may be utilized in a self-supporting, cantilevered fire wall, a thin load-bearing partition wall, a Kevlar-skinned military structure with stalks grown nearby, and/or an air-lifted cabin made with ultralight fabric-skinned panels (e.g., for the National Park System or the U.S. Forest Service).

In at least some exemplary embodiments, the exemplary disclosed system, apparatus, and method may increase a bond strength between ends of the exemplary disclosed structural members (e.g., the stalk ends) and the exemplary disclosed face layers (e.g., end members 115 and 120). The ends of the stalks may be bent or frayed so as to create additional surface area for bonding. Alternatively, frayed ends may form an integral face layer with the addition of adhesive.

In at least some exemplary embodiments, elongated structural members 125 may be aligned or within 10 degrees of parallel. Additional elongated plant members or stalks may be included in the exemplary disclosed structural assembly 105 that may be oriented in one or more direction other than that of the primary aligned stalks (e.g., direction 145). For example, some elongated plant members may be skewed in different directions in different layers within a single structural assembly or in a single direction. The skewed structural members may, for example, provide in-plane racking resistance in shear walls. Further, corners or edges of the exemplary disclosed structural assembly (e.g. blocks) may be chamfered or curved. Face layers (e.g., end members 115 and 120) may be rounded at the corner to help to retain the outermost stalks. Additional materials may be included in core assembly 110 such as insulation particles or fibers or free-draining particles. Structural members 125 may be infused with chemical additives such as phase change materials for thermal energy storage, fire retardant chemicals (e.g. borax or ammonium phosphate), and/or pest-deterrent compounds (e.g. extracts from cedar or black locust trees, biocides, fungicides). Structural members 125 may be thermally modified to increase durability or steam bent (e.g. its shape changed in cross section and/or along its length with application of steam). To reduce moisture absorption and increase durability, stalk ends may be plugged with water-tolerant end members (e.g. face layers that are able to maintain their shape and the majority of their strength when exposed to water), which further may be improved by selecting plants with intact water-repellant or hydrophobic surfaces such as with a water contact angle of 85 or greater. Alternatively, the stalks may be mineralized, coated with clay, or treated with water-repellant coatings such as natural drying oils or silica-based coatings. A sanitizing step may be used to reduce a load of naturally occurring microbial life on the stalks. Additional adhesive may be used along the outermost stalks to reduce their outer bowing under load and therefore increase the overall compressive strength of the block.

In at least some exemplary embodiments, the exemplary disclosed structural assemblies (e.g., blocks) may incorporate chases for electrical and plumbing runs such as in grooves formed by end members 115 and 120 or linear voids running parallel to the stalks. Also, airtightness of a block assembly may be achieved in multiple ways. A continuous plaster layer that may serve as a WRB or finish may also provide an airtight assembly using known air sealing details at intersections with other elements such as windows, floors, and other elements. Alternatively, lapped WRB sheets may be bonded together using permanent techniques such as using acrylic tapes, and/or reversible techniques such as clay slip, stitching or rolling WRB layers together. Mycelium may be grown integrally with, or as a separate layer attached to, face layers (end members 115 and 120).

In at least some exemplary embodiments, at connection points between walls and spanning members, a wood bearing block may be used as, or in addition to, a face layer (e.g., end members 115 or 120) to increase the stiffness or structural capacity of the connection. Blocks (e.g. similar to structural assembly 105) made from agricultural residues that may have a high moisture content at harvest may be made using open mesh layers for faces to provide for continued drying of the stalks. Alternatively for example, plant stalks may be dried to a safe level such as 16% moisture content, or other amount depending on the moisture sensitivity of the plant species utilized, prior to being incorporated into a block. Face layers (e.g., end members 115 and 120) may be formed from a layer of glue, adhesive, mortar, a layer of adhesive with embedded fibers, and/or by attachment to a pre-formed layer. Face layers may be attached with mechanical fasteners without the use of adhesive. Tightly packing the exemplary disclosed structural members together may increase a stiffness of a given panel. For example, a stiff panel may be achieved using flexible face layers by the friction developed by pre-pressing the stalks together in a direction perpendicular to their length.

The exemplary disclosed structural members may be attached or joined to each other and/or to the exemplary disclosed end members (e.g., end members 115 and 120) via any suitable technique. For example, cut end faces of the exemplary disclosed structural members may be joined by an epoxy or other gap-filling adhesive (e.g. configuration of attachment layer 135 shown in FIG. 3A). Cut end faces may be joined by a gap-filling adhesive with integral fiber reinforcing, including for example: a thermoplastic composite made of lignin, resin, and plant oils; biobased epoxy; oxidized drying oil such as linseed (e.g., rapeseed), hempseed, soybean oil, or similar materials; pre-grown, chopped and mycelium-bound hemp stalks and similar materials; and/or mineral binder (e.g., Portland cement, lime, gypsum, magnesium phosphate cement, geopolymer, sorel cement, silica based binders, clay plaster, etc.) with embedded fibers (e.g., made of polypropylene, fiberglass, wool, hemp, metal, or similar materials).

Cut ends of the exemplary disclosed structural members may be bonded to a plastic film (e.g. configuration shown in FIG. 3E) such as by melting the film (e.g., via thermoforming or laminating). Example plastic films may include: biodegradable plastics such as Polylactic acid (PLA), polyhydroxybutyrate (PHB), and polyhydroxyalkanoate (PHA); commodity plastics such as high density polyethylene (HDPE) and low density polyethylene (LDPE); woven tarp material; and/or nonwoven geotextile fabric.

Cut ends of the exemplary disclosed structural members may be bonded to a thermoplastic film with embedded fiber by melting the film. Cut end faces may be bonded to a second material (e.g., sheet material such as configurations shown in FIGS. 3B, 3C, and 3D) including for example: wood veneer; paper; coated paper (e.g. paper made waterproof with lignin coat that in turn is melted to act as a binder, or paper soaked in resin); fabric (e.g., woven or nonwoven); grid or mesh such as cheesecloth, fiberglass screen, and plastic grid (such as deer fencing); plywood, oriented strand board (OSB), strawboard, bamboo board, and/or cattail board; cement fiberboard or geopolymer fiberboard; solid sawn wood, finger-jointed wood board; fiber reinforced polymeric (FRP) sheet; metal sheet; and/or preformed thermoplastic. Cut end faces may be bonded to a disposable sheet material as an intervening step (e.g., before mortaring in place). Cut ends may be bonded to a mesh as intervening step that functions as reinforcing in the final use when mortared (e.g. configuration shown in FIG. 3J). For example, an intermediate block may be pre-fabricated by gluing cheesecloth to the stalk ends with polyvinylacetate (PVA) glue, moving the block to the construction site, and then using mortar to bond the blocks on site.

Cut ends of the exemplary disclosed structural members may be bonded by various methods or processes for example including: glue applied and drying with or without pressing; glue applied and curing in heat; glue applied and activating with an additive; casting faces directly onto stalks; casting faces separately then gluing faces onto stalks; lamination via heat or use of an adhesive; extrusion or thermoforming of faces from pellets directly onto stalks; water-curing or air-curing of mortar; growing mycelia (e.g., in chopped fibers and pressing onto stalk ends as pre-grown mycoleather and pressing onto stalk ends; as integrally grown with or without added nutrients on stalk ends; and/or cutting wood veneer, growing mycelium within it such that it is fuzzy, and pressing with heat onto stalk ends); biocementation; friction bonding (e.g., without the use of added glue, for example lignin within the stalks may be exuded and creates a bond); air forming of fibered face layers directly onto stalk ends; and/or pre-compressing stalks against stiff plates or by wrapping with tensioned fabric.

The exemplary disclosed structural members may be attached or joined to each other and/or to the exemplary disclosed end members (e.g., end members 115 and 120) using any suitable adhesive materials for example including: polyvinylacetate (PVA); wood glue; rabbit glue; protein-based glue; starch; epoxy; MDI; polyurethane; lime; cement; gypsum; clay; biocement; added or internal lignin (e.g., lignin and hemicellulose contained within the stalks themselves); resin; oxidized drying oil such as linseed oil; thermoplastic adhesive (e.g., vinyl acetate system, acrylic system, polyamide system, polyester system, or polyurethane system); hot-setting adhesive and/or thermoset polymers (e.g., amino system, urea system, melamine system, phenol system, resorcylic system, xylene system, furan system, epoxy system, urethane system, acryl system, or unsaturated polyester system); hot-melting adhesive (e.g., including reaction setting adhesive); natural rubber from dandelion exudate, rubber-system adhesive, cyanoacrylate adhesive, synthetic water-soluble adhesive, emulsion adhesive, or liquid polymer adhesive; and/or mycelium.

In at least some exemplary embodiments, the exemplary disclosed system, apparatus, and method may include layered load-resisting blocks or panels made of end-bonded and aligned plant stalks (e.g., and assemblies made of the same). The exemplary disclosed biocomposite load-resisting elements or structural members may be made up of a plurality of substantially intact, aligned, elongated plant segments or stalks and a layer for joining said stalks at their cut ends faces such that a plurality of stalks are disposed in both directions perpendicular to the stalk length (e.g., thus forming a volume). The stalks may be oriented so as to resist compression and/or tension stresses parallel to their length. The stalks may be held together as a block or panel without including intervening adhesive along a stalk length. The material may have insulating properties.

In at least some exemplary embodiments, the exemplary disclosed system, apparatus, and method may include aligned structural members (e.g., stalk material) that may improve the economics, breadth of adoption and applicability, and ease of use of low impact (e.g., ecological), low embodied energy, carbon-storing materials (e.g., such that abundant plant resources with short growth cycles are usable for a number of precision applications including construction and other material goods). For example, the exemplary disclosed system, apparatus, and method may expand accessibility of natural materials to both small, self-builder projects and large building types in dense urban environments or those involving offsite premanufacture and rapid assembly.

In at least some exemplary embodiments, the exemplary disclosed system, apparatus, and method may provide structural material with increased compressive strength, increased stiffness in compression, and a reduced material cost for binder (e.g., for attaching or joining). The exemplary disclosed system, apparatus, and method may provide structural material with suitable strength, insulating value, and binder amount.

The exemplary disclosed system, apparatus, and method may be used in any suitable application for building or involving structural material. For example, the exemplary disclosed system, apparatus, and method may be used for structural walls, floors, roofs, beams, columns, long-span tensile roofs (e.g., with insulating properties); a "monowall" that may provide structure, insulation, interior finish, drainage plane, and rainscreen exterior finish in a single element; pre-fabricated mass walls; curtainwalls; non-load bearing interior walls, partitions, movable partitions, ceilings, exterior insulation, exterior insulation and finish systems (EIFS), siding, siding with integral rainscreen, casework, furniture, fences, and/or noise barriers (e.g., non-insulating uses); a water resistive barrier; a fire-resistant wall assembly; a cantilevered fire wall; toys (e.g., play houses); pallets; theater props; vehicle hulls; and/or floating devices.

In at least some exemplary embodiments, the exemplary disclosed apparatus may be an apparatus for resisting a gravity load, including a first end member, a second end member, and a plurality of elongated structural members, each of the plurality of elongated structural members including a first end portion attached to the first end member and a second end portion attached to the second end member. The plurality of elongated structural members may be oriented to resist compressive stresses or tensile stresses induced by the gravity load. The plurality of elongated structural members may be formed from plants with a harvest cycle of four years or fewer. The plurality of elongated structural members may include multiple layers of elongated structural members. The plurality of elongated structural members may be a plurality of intact plant stalks. The plurality of elongated structural members may be oriented parallel to a direction of the gravity load. The plants with a harvest cycle of four years or fewer may be plants of the Poales order. The plurality of elongated structural members may be oriented between 30 degrees and 90 degrees from a direction of the gravity load. The plurality of elongated structural members may be a plurality of plants with the harvest cycle of four years or fewer having their original natural cross section intact. At least some of the plurality of elongated structural members may include plants having an epidermis with an initial water contact angle of 85 or greater. The exemplary disclosed apparatus may also include an attached siding, wherein a rainscreen air gap may be formed between the plurality of elongated structural members and the attached siding based on the attached siding being supported by one or more protrusions facing the rainscreen air gap. The exemplary disclosed apparatus may further include a plaster layer disposed on an exterior surface of the plurality of elongated structural members. The plaster layer may be an air-tight layer. The plaster layer may be at least one of a finish layer, a wind-tight layer, or a water-resistive barrier. The first end member, the second end member, and the plurality of elongated structural members may form a first building block. At least one of the first end member, the second end member, and an exterior surface of the plurality of elongated structural members may include at least one of a protrusion or a recess. The exemplary disclosed apparatus may also include a brace configured to restrain the plurality of elongated structural members against outward buckling under the loading force, the brace including at least one of a girding tie disposed about the plurality of elongated structural members or an adhesive disposed at one or more points along a length of at least some of the plurality of elongated structural members. The exemplary disclosed apparatus may further include a coating disposed on surfaces of some or all of the plurality of elongated structural members. The coating may be formed from at least one material selected from the group of a cementitious mineralizing material, a clay slip, a water-resisting agent, a silica-based coating, and combinations thereof. The first end member and the second end member may be formed from flexible material or semi-flexible material. The first end member and the second end member may be formed from at least one material selected from the group of mineral binders containing no substantial non-mineral additives, natural materials, demountable rigid faces, demountable tensioned fabric wrap, and combinations thereof. Each of the first end member and the second end member may be formed from adhesive material. Each of the plurality of elongated structural members may extend between the first and second end members without any attachment to the other elongated structural members other than the attachment at the first and second end members. The plurality of elongated structural members may form one or more of a gap, channel, or void, or combinations thereof between each other, the gap, channel, or void extending from the first end member to the second end member.

In at least some exemplary embodiments, the exemplary disclosed method may be a method for resisting a gravity load. The method may include providing a first end member, providing a second end member, and attaching a first end portion of each of a plurality of elongated structural members to the first end member, attaching a second end portion of each of the plurality of elongated structural members to the second end member, and resisting the gravity load by resisting at least one of tensile or compressive stresses induced by the gravity load in the plurality of elongated structural members. The plurality of elongated structural members may be formed from plants with a harvest cycle of four years or fewer. The exemplary disclosed method may also include forming a structure by assembling a plurality of blocks. Each of the plurality of blocks may include the plurality of elongated structural members attached between the first end member and the second end member. Assembling the plurality of blocks may include attaching the plurality of blocks together using at least one selected from the group of adhesive, mortar, fungal mycelium, dry stacking with mechanical fasteners joining embedded wood members, dry stacking with linear dowel fasteners disposed on the interior of said blocks, dry stacking combined with a tension layer, or mortaring combined with a tension layer, and combinations thereof. The structure may be at least one of a panel, a wall, a pre-fabricated mass panel, a beam, a roof, a floor, a partition, or a siding. No cut end faces may be disposed into the interior of the apparatus. The elongated structural members may have thermal insulating properties.

In at least some exemplary embodiments, the exemplary disclosed apparatus may be an apparatus for resisting a loading force. The apparatus may include a plurality of elongated plant segments. The elongated plant segments may be substantially aligned. The aligned plant segments may together form a volume with a plurality of the plant segments disposed in each direction perpendicular to the length of said plant segments. The elongated plant segments may be perpendicular to the width of the apparatus and parallel to at least one of tensile or compressive stresses within the apparatus. The elongated plant segments may have a substantially preserved natural cross section. Each of the elongated plant segments may include two cut end faces. Said cut end faces may be connected together by at least one of an adhesive layer coating the ends, an adhesive with embedded reinforcing, a mortar, a mortar with embedded reinforcing, a pre-formed sheet layer attached with an adhesive, a thermoformed sheet layer, a rigid face layer attached using pre-tensioning without adhesive to press against the cut end faces such that friction holds the cut end faces in place, or a flexible pre-tensioning member that wraps four sides of the element with applied pressure. The elongated plant segments may be selected from the group of switchgrass, straw, grasses, rice stalk, wheat stalk, barley, oats, rye, flax, agricultural biomass, crop residue, corn stover, corn stalk, corn cob, cattail leaves, cattail stalks, Typha species, *Miscanthus giganteus, Miscanthus* species, palm fronds, sunflower stalks, Jerusalem artichoke, tobacco stalks, furled leaves, reed, kenaf, hemp, sorghum, willow stems, poplar stems, black locust stems, giant reed, river cane, Poales order of plants, rattan, bagasse, rapeseed, jute, balsa stems, bamboo, and combinations thereof.

In at least some exemplary embodiments, the exemplary disclosed system, apparatus, and method may provide an efficient and effective system for building and providing structures. The exemplary disclosed system, apparatus, and method may provide building components of relatively high compressive strength and stiffness that may be appropriate for use in tall buildings of at least up to 6 stories tall, or in a range from 1 to 22 stories. The exemplary disclosed system, apparatus, and method may provide relatively strong and stiff structural insulation. The exemplary disclosed system, apparatus, and method may combine multiple functions such as structure, insulation, fire resistance, sound attenuation, finish and finish support, airtight layer, and/or drainage plane into a single element. The exemplary disclosed system, apparatus, and method may utilize materials that may be formed from materials that are environmentally friendly and are not energy-intensive or carbon-intensive to produce. The exemplary disclosed system, apparatus, and method may provide a manufacturing method for building components and construction method that may be inexpensive, "rain safe" during construction, reduce mold risk, and produce lightweight building components. The exemplary disclosed system, apparatus, and method may be used for building long-span, tensile roof systems and other similar structures that may reduce the use of high-embodied energy materials such as concrete, steel, and foam insulation. The exemplary disclosed system, apparatus, and method may utilize materials that may be demounted and reused or compostable at an end of a service life of structures in which the materials may be utilized.

It will be apparent to those skilled in the art that various modifications and variations can be made to the exemplary disclosed system, apparatus, and method. Other embodiments will be apparent to those skilled in the art from consideration of the specification and practice of the exemplary disclosed apparatus, system, and method. It is intended that the specification and examples be considered as exemplary, with a true scope being indicated by the following claims.

What is claimed is:

1. An apparatus for resisting a gravity load, comprising:
a first end member;
a second end member; and
a plurality of elongated structural members, each of the plurality of elongated structural members including a first end portion attached to the first end member and a second end portion attached to the second end member;
wherein the plurality of elongated structural members is oriented to resist substantially all compressive stress induced by the gravity load in the first end member, the second end member, and the plurality of elongated structural members; and
wherein the plurality of elongated structural members is formed from plants with a harvest cycle of four years or fewer.

2. The apparatus of claim 1, wherein a volume defined by the plurality of elongated structural members has a thickness of more than one of the plurality of elongated structural members.

3. The apparatus of claim 1, wherein the plurality of elongated structural members is a plurality of plant stalks with few bends, splits, or crushed portions.

4. The apparatus of claim 1, wherein the gravity load is an axial load and the plurality of elongated structural members is oriented vertically.

5. The apparatus of claim 1, wherein the plants with a harvest cycle of four years or fewer are plants of the Poales order other than bamboo.

6. The apparatus of claim 1, wherein:
the apparatus is a spanning member; and
the plurality of elongated structural members is oriented in the longitudinal direction of the spanning member.

7. The apparatus of claim 1, wherein:
at least some of the plurality of elongated structural members on an exterior surface of the apparatus includes plants having a substantially unsplit and unpunctured surface with an initial water contact angle of 85 or greater, oriented substantially vertically so as to drain water, and forming a water resistive barrier for building use.

8. The apparatus of claim 1, further comprising an attached siding, wherein a rainscreen air gap is formed between the plurality of elongated structural members and the attached siding based on the attached siding being supported by one or more linear ridges facing the rainscreen air gap and formed integrally by a plurality of plant stalks.

9. The apparatus of claim 1, wherein:
the first end member, the second end member, and the plurality of elongated structural members form a building block; and
at least one of the first end member, the second end member, or an exterior surface of the plurality of elongated structural members includes at least one of a protrusion or a recess.

10. The apparatus of claim 1, further comprising a brace configured to restrain the plurality of elongated structural members against outward buckling under the loading force, the brace including at least one of a girding tie disposed about the plurality of elongated structural members or an adhesive disposed at one or more points along a length of at least some of the plurality of elongated structural members.

11. The apparatus of claim 1, wherein at least one of the first end member or the second end member is formed from flexible material or semi-flexible material.

12. The apparatus of claim 1, wherein at least one of the first end member or the second end member is formed from at least one material selected from the group of fiber reinforced mineral binders, wood, wood composites, fiber cement, mycelium, adhesive impregnated mesh, thermoplastic adhesive containing lignin, demountable rigid faces, demountable tensioned fabric wrap, and combinations thereof.

13. The apparatus of claim 1, wherein at least one of the first end member or the second end member consists of glue.

14. The apparatus of claim 1, wherein each of the plurality of elongated structural members extends between the first and second end members without any attachment to the other elongated structural members other than the attachment at the first and second end members.

15. The apparatus of claim 1, wherein the plurality of elongated structural members forms one or more of a gap, channel, or void, or combinations thereof between each other, the gap, channel, or void extending from through the first end member and the second end member.

16. The apparatus of claim 1, wherein no cut end faces are disposed into the interior of the apparatus.

17. The apparatus of claim 1, wherein the elongated structural members have thermal insulating properties.

18. The apparatus of claim 1, wherein the plurality of elongated structural members is disposed at more than one density.

19. The apparatus of claim 1, wherein the apparatus is self-supporting and the gravity load is the weight of the apparatus.

20. The apparatus of claim 1, further comprising plant segments oriented in one or more direction other than those of the plurality of elongated structural members.

21. The apparatus of claim 1, wherein the first end member and the second end member simultaneously resist substantially all compressive stress induced by the gravity load.

22. A structural system for resisting a gravity load comprising:

a plurality of stacked blocks;

wherein each of the plurality of stacked blocks includes a plurality of elongated structural members attached between a first end member and a second end member;

wherein cut end faces of the plurality of elongated structural members of adjacent blocks of the plurality of stacked blocks are oriented end-to-end such that they resist a majority of compressive stress induced by the gravity load in the first end member, the second end member, and the plurality of elongated structural members;

wherein each of the plurality of stacked blocks has an elastic modulus in compression greater than that of earth plaster;

wherein the end members of the plurality of stacked blocks are protected from fire by being embedded between the stacked blocks, and the end members plug the ends of the elongated structural members, preventing the influx of air during burning; and wherein the plurality of elongated structural members is formed from plants with a harvest cycle of four years or fewer, other than bamboo.

23. The structural system of claim 22, further comprising a thin earth plaster layer disposed on an exterior surface of the plurality of elongated structural members forming a continuous wall coating;

wherein an elastic modulus in compression of each of the plurality of stacked blocks is greater than that of the plaster layer such that the structural system provides a plaster base that supports the thin earth plaster layer without cracking when subjected to an axial compressive load.

24. The structural system of claim 12, wherein the plurality of stacked blocks are attached together via at least one selected from the group of adhesive, mortar, fungal mycelium, surface bonding mortar with embedded fibers, dry stacking with mechanical fasteners joining embedded wood members, a continuous surface-mounted tension layer, indented or surface-mounted tension ties, and combinations thereof.

25. The structural system of claim 22, wherein the structure is a portion of or an entirety of at least one of a panel, a wall, a pre-fabricated mass panel, a beam, a roof, a floor, a partition, a column, an insulation panel, a partition, a movable partition, a noise barrier, a fence, a door, a toy, casework, furniture, or a siding.

26. The structural system of claim 22, further comprising one or more wood members attached between the first end member and the second end member of one or more of the plurality of stacked blocks.

27. The structural system of claim 22, wherein the plurality of elongated structural members of one or more of the plurality of stacked blocks further resists a majority of tensile stress induced by the gravity load.

28. The structural system of claim 22, wherein the plurality of elongated structural members of one or more of the plurality of stacked blocks further resists substantially all compressive stress induced by the gravity load.

29. A structural assembly for resisting a loading force gravity load, comprising:

a first end member;

a second end member; and a plurality of substantially aligned elongated plant segments, each of the plurality of elongated plant segments including a first end portion attached to the first end member and a second end portion attached to the second end member;

wherein the gravity load is an axial load and the plurality of substantially aligned plant segments is oriented vertically such that they resist the majority of compressive stress induced by the gravity load in the first end member, the second end member, and the plurality of elongated plant segments;

wherein the first and second end members plug the ends of the plant segments, reducing water absorption;

wherein the end members are at least one of an adhesive layer coating the ends, an adhesive with embedded reinforcing, a mortar, a mineral binder with embedded reinforcing, a pre-formed sheet layer attached with an adhesive, a thermoformed sheet layer, a rigid face layer attached using pre-tensioning without adhesive to press against the end portions such that friction holds the end portions in place, or a flexible pre-tensioning member that wraps four sides of the element with applied pressure; and wherein the elongated plant segments are selected from the group of switchgrass, straw, grasses, rice stalk, wheat stalk, barley, oats, rye, flax, agricultural biomass, crop residue, corn stover, corn stalk, corn cob, cattail leaves, cattail stalks, Typha species, *Miscanthus giganteus, Miscanthus* species, palm fronds, sunflower stalks, Jerusalem artichoke, tobacco stalks, furled leaves, reed, kenaf, hemp, sorghum, willow stems, poplar stems, black locust stems, giant reed, river cane, Poales order of plants other than bamboo, rattan, bagasse, rapeseed, jute, balsa stems, and combinations thereof.

* * * * *